US010969730B2

(12) United States Patent
Sueshige et al.

(10) Patent No.: US 10,969,730 B2
(45) Date of Patent: Apr. 6, 2021

(54) IMAGE FORMING APPARATUS AND IMAGE FORMING UNIT

(71) Applicant: CANON KABUSHIKI KAISHA, Tokyo (JP)

(72) Inventors: Kazutaka Sueshige, Susono (JP); Tatsuro Harada, Mishima (JP); Takayuki Yada, Suntou-gun (JP); Tetsuo Uesugi, Suntou-gun (JP); Toru Oguma, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/798,610

(22) Filed: Feb. 24, 2020

(65) Prior Publication Data

US 2020/0272087 A1 Aug. 27, 2020

(30) Foreign Application Priority Data

Feb. 25, 2019 (JP) ..... 2019-032129
Nov. 26, 2019 (JP) ..... 2019-213564

(51) Int. Cl.
*G03G 21/16* (2006.01)
*G03G 21/18* (2006.01)

(52) U.S. Cl.
CPC ..... *G03G 21/1647* (2013.01); *G03G 21/1671* (2013.01); *G03G 21/1676* (2013.01); *G03G 2221/1678* (2013.01)

(58) Field of Classification Search
CPC ..... G03G 21/1647; G03G 21/1671; G03G 21/1676; G03G 21/1821; G03G 21/1825; G03G 2221/1651; G03G 2221/1678; G03G 2221/1853; G03G 2221/1869
See application file for complete search history.

(56) References Cited

U.S. PATENT DOCUMENTS

| | | | |
|---|---|---|---|
| 5,455,665 | A | 10/1995 | Baba et al. |
| 5,768,658 | A | 6/1998 | Watanabe et al. |
| 5,790,923 | A | 8/1998 | Oguma et al. |
| 5,812,909 | A | 9/1998 | Oguma et al. |
| 6,097,909 | A | 8/2000 | Watanabe et al. |
| 6,144,821 | A | 11/2000 | Oguma |

(Continued)

FOREIGN PATENT DOCUMENTS

| | | | |
|---|---|---|---|
| CN | 205015615 U | 2/2016 | |
| EP | 3156853 A1 * | 4/2017 | ..... G03G 21/1853 |

(Continued)

*Primary Examiner* — Sophia S Chen
(74) *Attorney, Agent, or Firm* — Venable LLP

(57) ABSTRACT

An image forming apparatus includes an apparatus body, a first cartridge detachably attached to the apparatus body, a second cartridge detachably attached to the apparatus body in a state where the first cartridge has been attached to the apparatus body, a guide unit configured to guide the first cartridge, and a drawer member configured to be inserted to and drawn out of the apparatus body in a direction intersecting the axial direction. The drawer member is inserted to the apparatus body in a state supporting the second cartridge. The first cartridge includes an engagement portion and the second cartridge includes an engaged portion, and the second cartridge is supported by the first cartridge via engagement of the engagement portion and the engaged portion.

15 Claims, 38 Drawing Sheets

(56) References Cited

U.S. PATENT DOCUMENTS

| | | | |
|---|---|---|---|
| 6,173,130 | B1 | 1/2001 | Oguma |
| 6,266,500 | B1 | 7/2001 | Numagami et al. |
| 6,272,299 | B1 | 8/2001 | Numagami et al. |
| 6,377,759 | B1 | 4/2002 | Abe et al. |
| 7,024,131 | B2 | 4/2006 | Komatsu et al. |
| 8,571,445 | B2 | 10/2013 | Komatsu et al. |
| 10,551,790 | B2 | 2/2020 | Komatsu et al. |
| 2001/0017990 | A1 | 8/2001 | Oguma et al. |
| 2001/0038758 | A1 | 11/2001 | Oguma et al. |
| 2002/0012542 | A1 | 1/2002 | Karakama et al. |
| 2002/0021908 | A1 | 2/2002 | Matsumoto et al. |
| 2002/0025174 | A1 | 2/2002 | Sakurai et al. |
| 2002/0025177 | A1 | 2/2002 | Yokoi et al. |
| 2002/0064930 | A1 | 5/2002 | Ishikawa |
| 2002/0067930 | A1 | 6/2002 | Oguma et al. |
| 2002/0122674 | A1 | 9/2002 | Yokoi et al. |
| 2002/0131791 | A1 | 9/2002 | Yokoi et al. |
| 2002/0172521 | A1 | 11/2002 | Oguma et al. |
| 2003/0068172 | A1 | 4/2003 | Komatsu et al. |
| 2003/0108358 | A1 | 6/2003 | Yokoi et al. |
| 2003/0113131 | A1 | 6/2003 | Watanabe et al. |
| 2003/0161644 | A1 | 8/2003 | Yokoi et al. |
| 2003/0161657 | A1 | 8/2003 | Yokoi et al. |
| 2003/0170061 | A1 | 9/2003 | Ito |
| 2004/0045156 | A1 | 3/2004 | Kikuchi et al. |
| 2004/0131382 | A1 | 7/2004 | Kikuchi et al. |
| 2005/0025508 | A1 | 2/2005 | Karakama et al. |
| 2005/0069338 | A1 | 3/2005 | Oguma et al. |
| 2005/0191080 | A1 | 9/2005 | Oguma et al. |
| 2005/0283973 | A1 | 12/2005 | Kikuchi et al. |
| 2006/0029416 | A1 | 2/2006 | Oguma et al. |
| 2006/0193653 | A1 | 8/2006 | Oguma et al. |
| 2007/0092285 | A1 | 4/2007 | Oguma et al. |
| 2007/0248382 | A1 | 10/2007 | Oguma et al. |
| 2010/0080615 | A1 | 4/2010 | Kikuchi |
| 2012/0243905 | A1 | 9/2012 | Uratani et al. |
| 2013/0336679 | A1 | 12/2013 | Furutani et al. |
| 2013/0343785 | A1 | 12/2013 | Matsuzaki et al. |
| 2014/0029974 | A1 | 1/2014 | Uesugi et al. |
| 2014/0072329 | A1 | 3/2014 | Uesugi et al. |
| 2014/0072330 | A1 | 3/2014 | Yoshida et al. |
| 2014/0072345 | A1 | 3/2014 | Matsunaga et al. |
| 2014/0112685 | A1 | 4/2014 | Komatsu et al. |
| 2014/0199093 | A1 | 7/2014 | Yoshida et al. |
| 2014/0363196 | A1 | 12/2014 | Wada et al. |
| 2015/0234319 | A1 | 8/2015 | Matsumura et al. |
| 2015/0277362 | A1* | 10/2015 | Yokoi ..... G03G 21/1647 399/119 |
| 2016/0070207 | A1 | 3/2016 | Yada et al. |
| 2016/0139558 | A1* | 5/2016 | Kawakami ..... G03G 21/1885 399/113 |
| 2016/0154374 | A1* | 6/2016 | Hiramatsu ..... G03G 21/1839 399/111 |
| 2016/0370756 | A1 | 12/2016 | Komatsu et al. |
| 2017/0108824 | A1* | 4/2017 | Kawakami ..... G03G 21/181 |
| 2017/0235251 | A1 | 8/2017 | Matsuzaki et al. |
| 2017/0248869 | A1 | 8/2017 | Matsumoto et al. |
| 2017/0248905 | A1 | 8/2017 | Anan et al. |
| 2017/0261917 | A1 | 9/2017 | Harada et al. |
| 2017/0351214 | A1 | 12/2017 | Uesugi et al. |
| 2018/0046130 | A1 | 2/2018 | Komatsu et al. |
| 2018/0113399 | A1 | 4/2018 | Matsuzaki et al. |
| 2018/0164711 | A1* | 6/2018 | Numata ..... G03G 15/0817 |
| 2018/0329359 | A1 | 11/2018 | Anan et al. |
| 2019/0094759 | A1 | 3/2019 | Matsuzaki et al. |
| 2019/0179249 | A1 | 6/2019 | Mod et al. |
| 2019/0187608 | A1 | 6/2019 | Uesugi et al. |
| 2020/0033791 | A1 | 1/2020 | Uesugi et al. |
| 2020/0033792 | A1 | 1/2020 | Uesugi et al. |
| 2020/0033793 | A1 | 1/2020 | Uesugi et al. |
| 2020/0033794 | A1 | 1/2020 | Uesugi et al. |
| 2020/0033795 | A1 | 1/2020 | Uesugi et al. |
| 2020/0033796 | A1 | 1/2020 | Uesugi et al. |
| 2020/0033797 | A1 | 1/2020 | Uesugi et al. |
| 2020/0033798 | A1 | 1/2020 | Uesugi et al. |
| 2020/0033799 | A1 | 1/2020 | Uesugi et al. |
| 2020/0041953 | A1 | 2/2020 | Uesugi et al. |
| 2020/0041954 | A1 | 2/2020 | Uesugi et al. |
| 2020/0073323 | A1 | 3/2020 | Uesugi et al. |
| 2020/0073324 | A1 | 3/2020 | Uesugi et al. |
| 2020/0089159 | A1* | 3/2020 | Sato ..... G03G 21/1676 |
| 2020/0142345 | A1 | 5/2020 | Mori et al. |
| 2020/0150581 | A1 | 5/2020 | Komatsu et al. |
| 2020/0257238 | A1 | 8/2020 | Uesugi et al. |
| 2020/0272088 | A1 | 8/2020 | Sueshige et al. |

FOREIGN PATENT DOCUMENTS

| | | | | |
|---|---|---|---|---|
| EP | 3324244 | A1 * | 5/2018 | ..... G03G 21/1676 |
| JP | 2009-157389 | A | 7/2009 | |
| JP | 2010-102285 | A | 5/2010 | |
| JP | 2016-218271 | A | 12/2016 | |

* cited by examiner

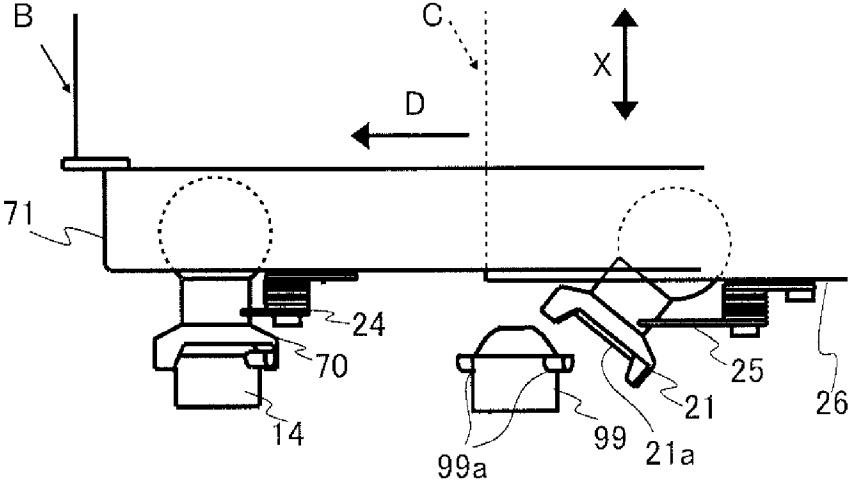
FIG.23A
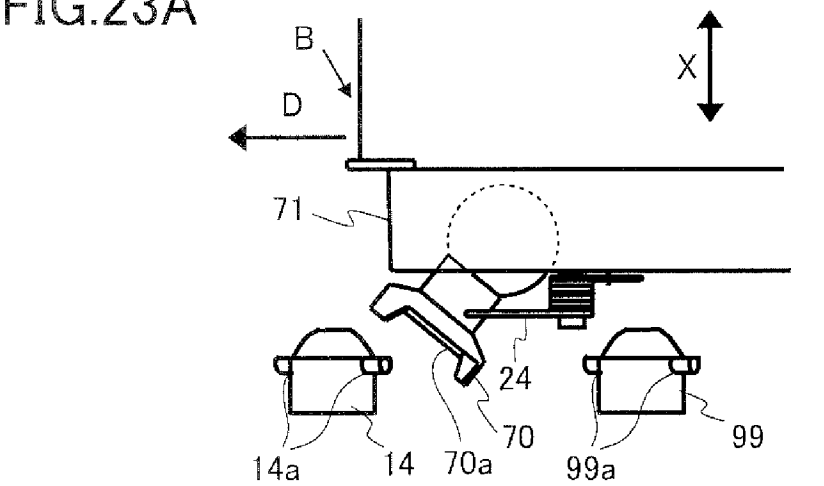
FIG.23B
FIG.23C
FIG.23D

IMAGE FORMING APPARATUS AND IMAGE FORMING UNIT

BACKGROUND OF THE INVENTION

Field of the Invention

The present invention relates to an image forming apparatus for forming an image on a recording medium, and an image forming unit for use in the image forming apparatus.

Description of the Related Art

Heretofore, there has been disclosed an image forming apparatus that adopts an electrophotographic system in which a member for performing an electrophotographic process is arranged in a cartridge that can be detachably attached to the apparatus body, so that a user or a maintenance operator can perform replacement operations easily, by which usability is improved. Japanese Patent Application Laid-Open Publication No. 2009-157389 discloses a configuration in which a process cartridge including a photosensitive drum and a developing roller are attached to a tray capable of being drawn out of an apparatus body, and by inserting the tray to the apparatus body, the process cartridge can be attached to the apparatus body. Further, Japanese Patent Application Laid-Open Publication No. 2016-218271 discloses a configuration in which waste toner collected from a photosensitive drum after transfer is conveyed to a waste toner storage portion arranged at a position distant from the photosensitive drum.

According to the configuration of the above-described documents, the photosensitive drum and the developing roller are arranged in a single cartridge, but in some cases, a plurality of cartridges are provided according to the difference in service life of respective members, for example.

SUMMARY OF THE INVENTION

The present technique provides an image forming apparatus and an image forming unit that has been developed based on the conventional configurations.

According to one aspect of the invention, an image forming apparatus includes: an apparatus body; a first cartridge including an image bearing member configured to rotate, the first cartridge being detachably attached to the apparatus body; a second cartridge including a developer bearing member configured to bear developer used to develop a latent image borne on the image bearing member, the second cartridge being detachably attached to the apparatus body in a state where the first cartridge has been attached to the apparatus body; a guide unit configured to guide the first cartridge in a direction intersecting an axial direction of the image bearing member in a state where the first cartridge has been attached to the apparatus body; and a drawer member configured to be inserted to and drawn out of the apparatus body in a direction intersecting the axial direction, wherein in a case where the second cartridge is attached to the apparatus body, the drawer member is inserted to the apparatus body in a state supporting the second cartridge, wherein the first cartridge includes an engagement portion, and wherein the second cartridge includes an engaged portion configured to be engaged with the engagement portion in a course of inserting the drawer member to the apparatus body, and the second cartridge is supported by the first cartridge via engagement of the engagement portion and the engaged portion.

According to another aspect of the invention, an image forming unit configured to be attached to an apparatus body of an image forming apparatus, the image forming unit including: a first cartridge including an image bearing member configured to rotate, the first cartridge being configured to be detachably attached to the apparatus body; and a second cartridge including a developer bearing member configured to bear developer used for developing a latent image borne on the image bearing member, the second cartridge being configured to be detachably attached to the apparatus body in a state where the first cartridge has been attached to the apparatus body, wherein the first cartridge is configured to be guided in a direction intersecting an axial direction of the image bearing member by a guide unit provided on the apparatus body in a case where the first cartridge is attached to the apparatus body, wherein the second cartridge is configured to be inserted to the apparatus body in a state being supported by a drawer member that is configured to be inserted to and drawn out of the apparatus body in a direction intersecting the axial direction in a case where the second cartridge is attached to the apparatus body, wherein the first cartridge includes an engagement portion, and wherein the second cartridge includes an engaged portion configured to be engaged with the engagement portion in a course of inserting the drawer member to the apparatus body, and the second cartridge is supported by the first cartridge via engagement of the engagement portion and the engaged portion in a state where the second cartridge has been attached to the apparatus body.

Further features of the present invention will become apparent from the following description of exemplary embodiments with reference to the attached drawings.

BRIEF DESCRIPTION OF THE DRAWINGS

FIG. 23A is a view illustrating a step of establishing a drive connection of the process unit and the apparatus body according to the first embodiment.

FIG. 23B is a view illustrating a step of establishing the drive connection of the process unit and the apparatus body according to the first embodiment.

FIG. 23C is a view illustrating a step of establishing the drive connection of the process unit and the apparatus body according to the first embodiment.

FIG. 23D is a view illustrating a step of establishing the drive connection of the process unit and the apparatus body according to the first embodiment.

DESCRIPTION OF THE EMBODIMENTS

Now, embodiments for carrying out the present invention will be described with reference to the drawings.

Examples of image forming apparatuses in the following description include copying machines, printers, multifunction devices, commercial printing devices and so on. Image is formed on a recording medium based on image information entered from an external computer or image information read from documents. Various types of sheet material of various materials and shapes can be used, such as normal paper and thick paper, plastic films, coated paper, special-shaped sheets such as envelopes and index sheets, and cloth.

First Embodiment

Figure 1:
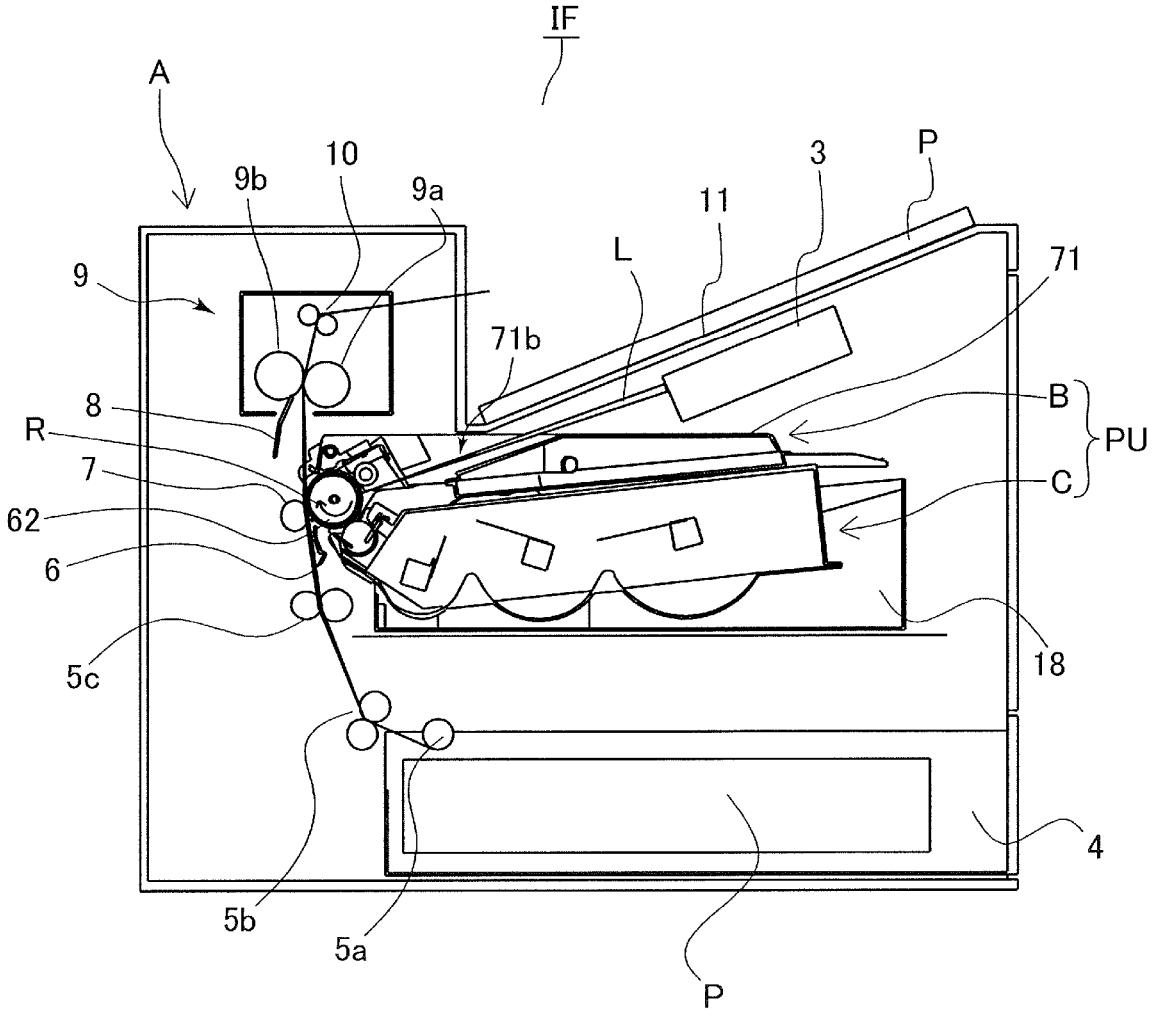
FIG. 1 is a schematic drawing of an image forming apparatus according to a first embodiment.
Figure 2:
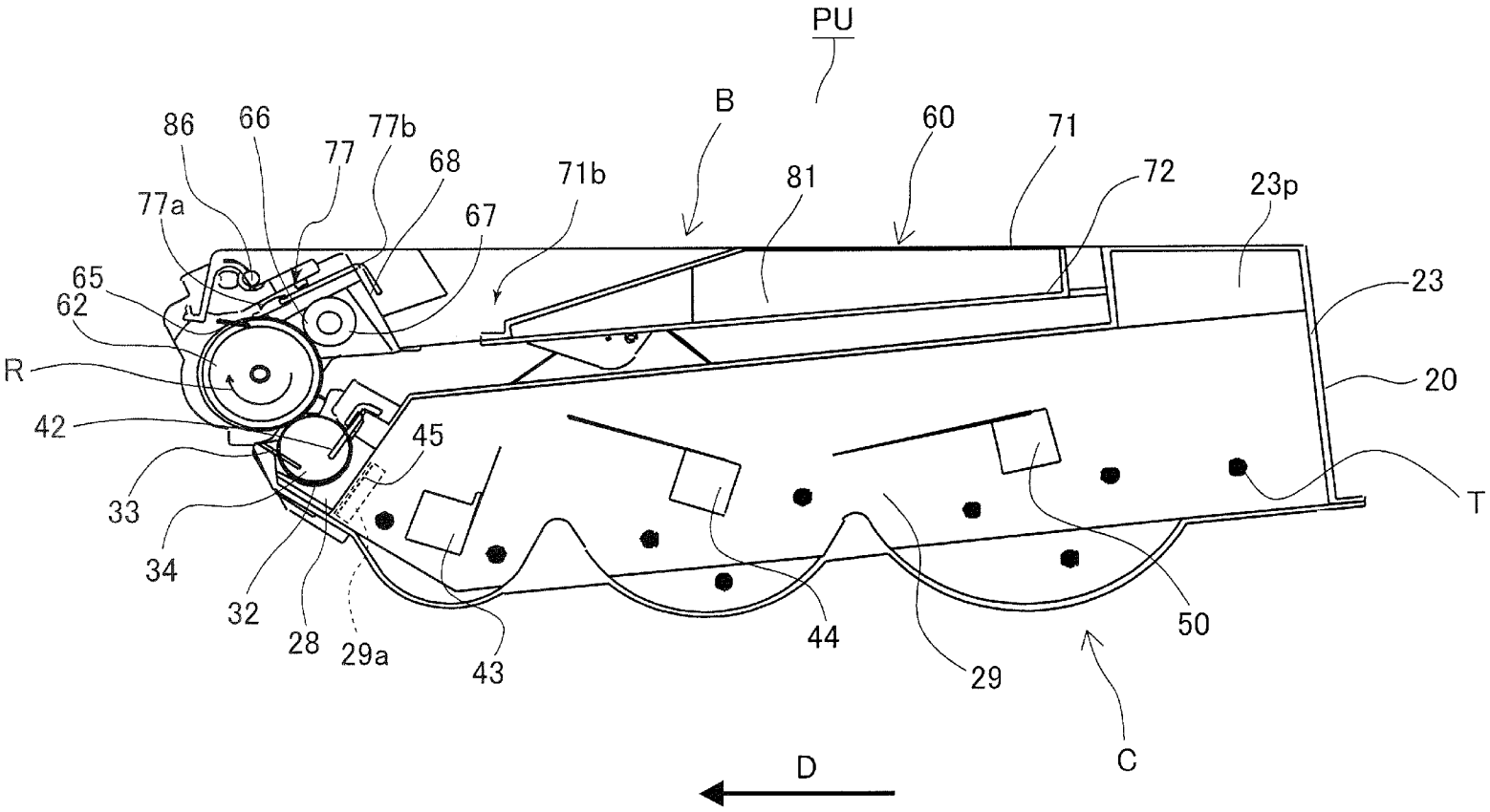
FIG. 2 is a schematic drawing of an image forming unit according to the first embodiment.

An image forming apparatus according to a first embodiment will be described. FIG. 1 is a schematic drawing illustrating a cross-sectional configuration of an image forming apparatus IF according to the present embodiment, and FIG. 2 is a schematic drawing of a photoconductor cartridge B and a developing cartridge C. As illustrated in FIG. 1, the photoconductor cartridge B and the developing cartridge C are attached to an apparatus body A of the image forming apparatus IF, forming a process unit PU in which an image is formed on a sheet P serving as a recording medium. The apparatus body A refers to the portion of the image forming apparatus IF excluding the photoconductor cartridge B and the developing cartridge C, and it includes a metal frame constituting a frame body of the image forming apparatus IF and an exterior cover constituting the surface of the casing.

The process unit PU is an image forming unit according to the present embodiment that can be attached to and detached from the apparatus body of the image forming apparatus. Further, the photoconductor cartridge B is a first cartridge according to the present embodiment, and the developing cartridge C is a second cartridge according to the present embodiment.

General Configuration of Image Forming Apparatus

As illustrated in FIG. 1, the image forming apparatus IF according to the present embodiment is a laser beam printer that adopts an electrophotographic system in which an electrostatic latent image is formed on a surface of a photosensitive drum 62 using laser beam, and the image is developed using developer and transferred to a sheet P. The apparatus body A includes, in addition to the photoconductor cartridge B and the developing cartridge C, a laser scanner 3 serving as an exposing unit, a fixing unit 9 serving as a fixing portion, and a sheet tray 4 serving as a sheet supporting portion. Further, the apparatus body A includes, along a direction in which the sheet P is conveyed from the sheet tray 4, a pickup roller 5*a*, a feed roller pair 5*b*, a conveyance roller pair 5*c*, a transfer guide 6, a transfer roller 7, a conveyance guide 8, the fixing unit 9, a sheet discharge roller pair 10, and a sheet discharge tray 11.

As illustrated in FIG. 2, the photoconductor cartridge B includes the photosensitive drum 62, a charging roller 66 serving as a charging portion, and a cleaning member 77 serving as a cleaning unit. The photosensitive drum 62 serving as an image bearing member according to the present embodiment is a drum-shaped photoconductor. The developing cartridge C includes a developing roller 32 serving as a developer bearing member, a toner chamber 29 serving as a developer storage portion, and a toner supply chamber 28. The charging roller 66 that carries out a charging process, the developing roller 32 that carries out a developing process, the transfer roller 7 that carries out a transferring process, and the cleaning member 77 that carries out a cleaning process are all examples of a processing unit that performs processes to the photoconductor in the electrophotographic processing.

In a state where the image forming apparatus IF receives an instruction, i.e., print start signal, to start forming an image to the sheet P, the photosensitive drum 62 is driven to rotate at a predetermined peripheral speed, i.e., processing speed, in the direction of arrow R. The charging roller 66 to which bias voltage has been applied contacts an outer peripheral surface of the photosensitive drum 62 and charges a surface of the drum uniformly and evenly. The laser scanner 3 irradiates a laser beam L modulated based on the image information (refer to FIG. 1) to the photosensitive drum 62 through a laser opening 71*b* provided on the photoconductor cartridge B and forms an electrostatic latent image on the drum surface.

As illustrated in FIG. 2, developer stored in the toner chamber 29 in the developing cartridge C is sequentially sent to the toner supply chamber 28. In the toner supply chamber 28, toner T is borne on the surface of the developing roller 32 by magnetic force of a magnet roller 34 arranged in the developing roller 32. Toner T that has reached a developing area where the developing roller 32 and the photosensitive drum 62 oppose to each other is transferred from the developing roller 32 to the drum surface according to a potential distribution on the surface of the photosensitive drum 62. Thereby, the electrostatic latent image on the drum surface is visualized as toner image.

In parallel with this process, feeding of sheet P is carried out at a synchronized timing with an exposing operation by the laser scanner 3. The pickup roller 5*a* illustrated in FIG. 1 contacts an uppermost sheet P on a sheet bundle supported on the sheet tray 4 and conveys the sheet P from the sheet tray 4. The feed roller pair 5*b* receives the sheet P from the pickup roller 5*a* and conveys the sheet to the conveyance roller pair 5*c* while separating the sheets one by one. The conveyance roller pair 5*c* conveys the sheet P to a transfer portion provided between the photosensitive drum 62 and the transfer roller 7 through the transfer guide 6. By having bias voltage applied to the transfer roller 7, the toner image borne on the photosensitive drum 62 is transferred to the sheet P at the transfer portion.

The sheet P to which toner image has been transferred is separated from the photosensitive drum 62 and conveyed to the fixing unit 9 along the conveyance guide 8. The fixing unit 9 includes a rotary member pair composed of a heating roller 9*a* and a pressure roller 9*b*, and a heat source, such as a halogen lamp, that heats the sheet P through the heating roller 9*a*. The fixing unit 9 applies heat and pressure to the toner image on the sheet while nipping and conveying the sheet P. Thereby, toner particles are melted and then adhered, by which the image is fixed to the sheet P. The sheet P having gone through the image fixing process is discharged by the sheet discharge roller pair 10 onto the sheet discharge tray 11 provided on an upper portion of the apparatus body A.

The cleaning member 77 removes foreign substances such as residual toner remaining on the photosensitive drum 62 that has not been transferred to the sheet P at the transfer portion. Thereby, the surface of the photosensitive drum 62 is cleaned to be prepared for the next image forming process.

Configuration of Cartridge of Process Unit

Next, a configuration of the process unit PU will be described. In the following description, a rotational axis direction, i.e., axial direction, of the photosensitive drum 62 and an axial direction of the developing roller 32 arranged in parallel therewith are referred to as a reference axis direction, in other words, longitudinal direction, of the photoconductor cartridge B and the developing cartridge C. In the reference axis direction, a side having a coupling for the photoconductor cartridge B and the developing cartridge C to receive driving force from the apparatus body A is referred to as a drive side of the photoconductor cartridge B and the developing cartridge C, and a side opposite therefrom is referred to as a non-drive side.

As illustrated in FIG. 2, a casing of the photoconductor cartridge B is composed of a cleaning frame member 71, and a lid member 72 fixed to the cleaning frame member 71 by a method such as welding. The cleaning frame member 71 supports the photosensitive drum 62 arranged at an opening portion thereof, and also supports the charging roller 66 and the cleaning member 77 in contact with the outer peripheral surface of the photosensitive drum 62. The above-described laser opening 71*b* is provided on the cleaning frame member 71 (also refer to FIG. 18). Further, the lid member 72 is a member that covers a lower portion of the cleaning frame member 71, and together with the cleaning frame member 71, it forms a space 81 that stores waste removed from the photosensitive drum 62 by the cleaning member 77. The main component of waste collected by the cleaning member 77 is waste toner that has not been transferred to the sheet at the transfer portion, and in addition thereto, paper dust and the like adhered to the photosensitive drum 62 from the sheet P are also collected.

Figure 19:
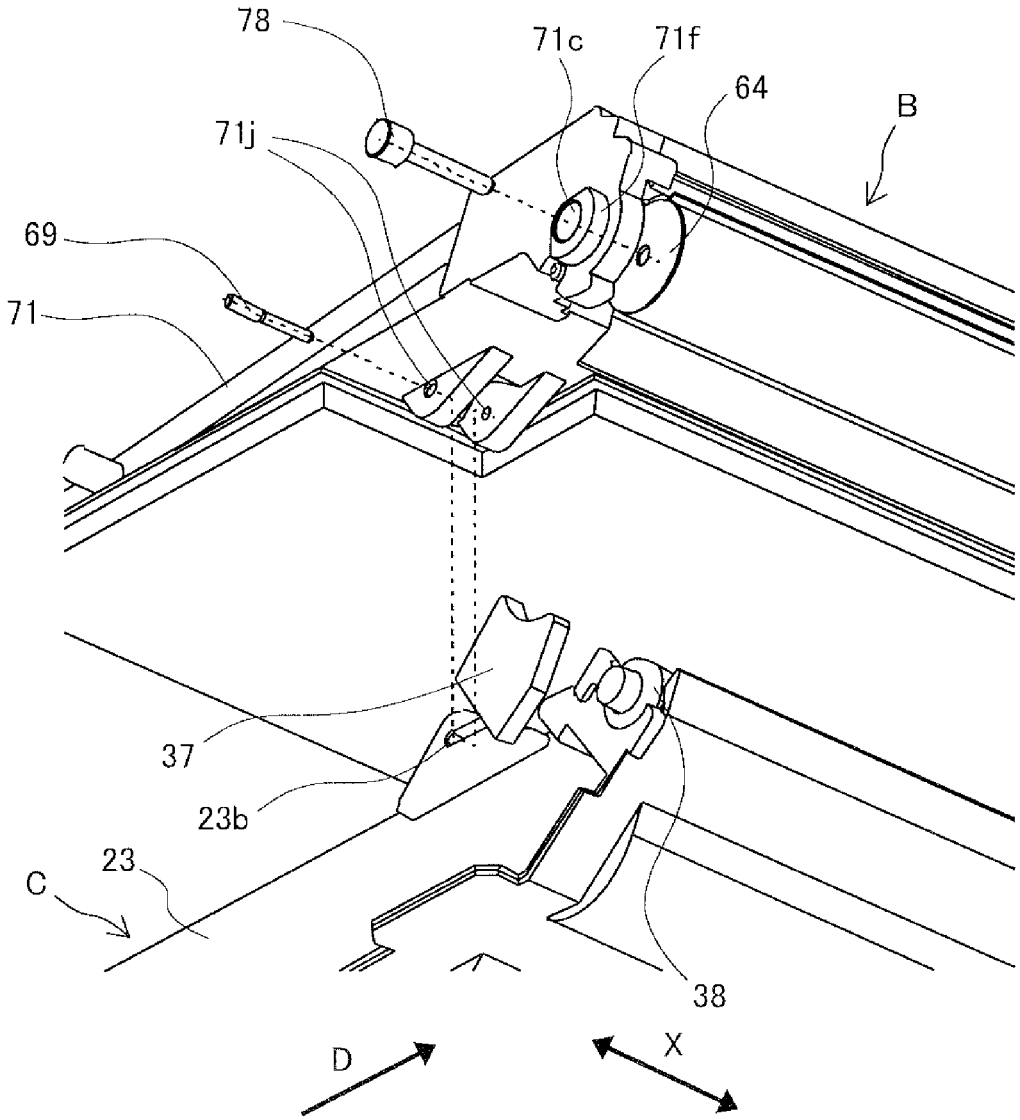
FIG. 19 is an exploded view of the process unit according to the first embodiment.
Figure 21:
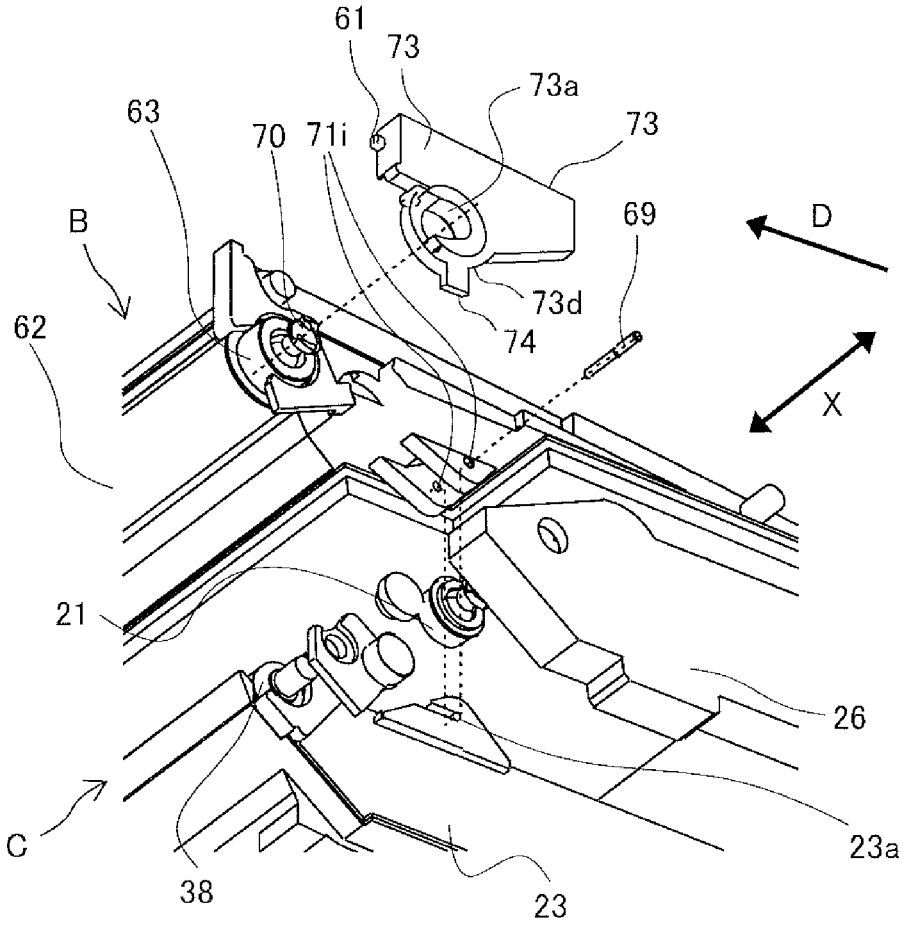
FIG. 21 is an exploded view of the process unit according to the first embodiment.

The photosensitive drum 62 has both ends thereof in the reference axis direction supported rotatably by the cleaning frame member 71, and it is configured to rotate in an arrow R direction in the drawing by receiving driving force from a drive motor (not shown) which serves as a driving source provided on the apparatus body A. Specifically, as illustrated in FIG. 21, on the drive side in the reference axis direction, a boss portion 63 provided at an end portion of the photosensitive drum 62 is rotatably fit to a hole portion 73*a* of a drum bearing 73 fixed to the cleaning frame member 71. Meanwhile, on the non-drive side, as illustrated in FIG. 19, a drum shaft 78 press-fit to a hole portion 71*c* provided on the cleaning frame member 71 fits to a hole portion provided on an end portion 64 of the non-drive side of the photosensitive drum 62 and rotatably supports the photosensitive drum 62.

The cleaning member 77 includes a cleaning blade 77*a* serving as a blade-shaped member formed of an elastic material such as rubber, and a support member 77*b* that supports the blade. The cleaning blade 77*a* is in contact with the photosensitive drum 62 in a counter direction with respect to the direction of rotation of the photosensitive drum 62. That is, the cleaning blade 77*a* is inclined with respect to a radial direction of the photosensitive drum 62 that passes the contact point with the drum surface so that a tip portion thereof is arranged upstream in the direction of rotation of the photosensitive drum 62 as it approaches the rotational axis of the photosensitive drum 62. Further, a drum contact sheet 65 for preventing leakage of waste toner from the cleaning frame member 71 is arranged at an edge of an opening portion of the cleaning frame member 71 to which the photosensitive drum 62 is arranged, so as to contact the photosensitive drum 62.

The charging roller 66 is rotatably supported at both end portions in the reference axis direction by the cleaning frame member 71 via a charging roller bearing 67. Further, the charging roller 66 is pressed against the photosensitive drum 62 by having the charging roller bearing 67 pressed toward the photosensitive drum 62 by an urging member 68. The charging roller 66 rotates along with the photosensitive drum 62. The portions (71, 72, 77) having excluded the photosensitive drum 62 and the charging roller 66 from the photoconductor cartridge B constitute a cleaning unit 60 whose main function is to clean the photosensitive drum 62.

The developing cartridge C includes the developing roller 32, the magnet roller 34, a developer container 23, a developing blade 42, and a roller contact sheet 33. The magnet roller 34 is arranged on an inner side of the developing roller 32, and it is fixed to the developer container 23. The developing blade 42 and the roller contact sheet 33 are arranged at an opening portion of the developer container 23 to which the developing roller 32 is arranged. The developing blade 42 regulates a layer thickness of toner T that is borne on the developing roller 32 and moves toward the developing area, and applies frictional charge to toner T. The roller contact sheet 33 prevents toner T in the toner supply chamber 28 from leaking to the exterior of the developing cartridge C.

The above-described toner chamber 29 and toner supply chamber 28 are formed on the inner side of the developer container 23. A first conveyance member 43, a second conveyance member 44 and a third conveyance member 50 are arranged in the toner chamber 29, and the respective conveyance members 43, 44 and 50 function as agitating members that agitate toner T, and convey the toner T toward the toner supply chamber 28 while agitating the same. The developer container 23 constitutes a casing 20 of the developing cartridge C together with a driven-side side member 26 (refer to FIG. 18) fixed to the drive side in the reference axis direction.

The developing roller 32 has both end portions thereof in the reference axis direction supported rotatably by bearing members 27 and 37 (refer to FIG. 18) fixed to the developer container 23. Further, a gap retainer 38 (refer to FIG. 18) that has a somewhat greater outer diameter than an outer diameter of the developing roller 32 is attached to both end portions of the developing roller 32. In a state where the gap retainer 38 contacts the outer peripheral surface of the photosensitive drum 62, a predetermined minute gap is maintained between the developing roller 32 and the photosensitive drum 62 in the developing area.

As illustrated in FIG. 2, an opening portion 29*a* (area denoted by dashed line) that allows the toner chamber 29 and the toner supply chamber 28 to be communicated is provided on the developer container 23. Before the developing cartridge C attached to the apparatus body A is used for the first time, the opening portion 29*a* is sealed by a sealing member 45, and toner T is sealed in the toner chamber 29. The sealing member 45 is a sheet-like member formed of a material such as polyethylene, wherein a first end side is welded to the developer container 23 at a periphery of the opening portion 29*a*, and a second end side is fixed to the first conveyance member 43. Then, in a state where the first conveyance member 43 rotates when the developing cartridge C is used for the first time, the sealing member 45 is wound up by the first conveyance member 43 while peeling the portion attached to the developer container 23. Thereby, the opening portion 29*a* is released, toner T flows into the toner supply chamber 28, and the developing roller 32 will be in a state capable of bearing toner T.

Attachment and Detachment of Cartridge

Figure 3:
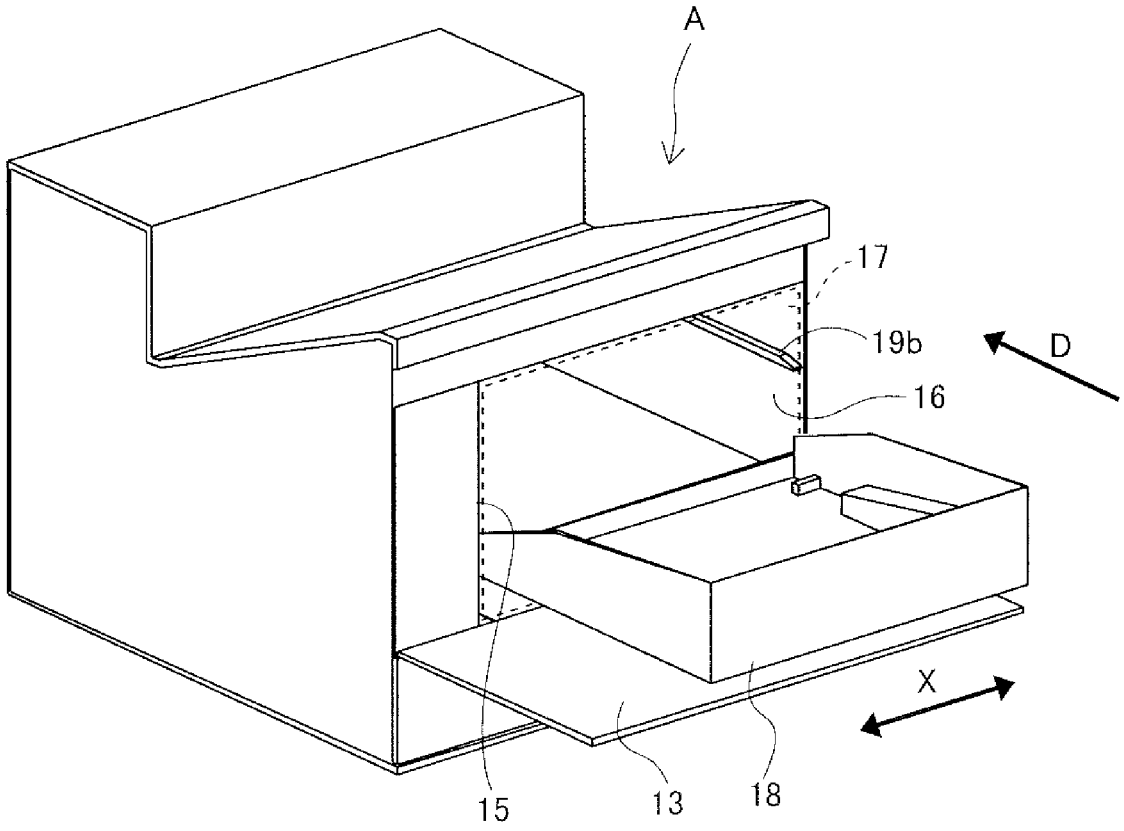
FIG. 3 is a perspective view of an apparatus body according to the first embodiment.

Next, a configuration for attaching and detaching the photoconductor cartridge B and the developing cartridge C to and from the apparatus body A will be described. FIG. 3 is a perspective view of the apparatus body A in a state where a door 13 is opened to allow attachment and detachment of the photoconductor cartridge B and the developing cartridge C. The door 13 is arranged pivotably on one side of the apparatus body A, and by opening the door 13, a cartridge insertion port 17 will be in an opened state. The photoconductor cartridge B and the developing cartridge C according to the present embodiment are attached to the apparatus body A by being inserted toward a direction of arrow D through the cartridge insertion port 17 serving as a common opening, and removed from the apparatus body A by being pulled out in a direction opposite thereto. The direction of arrow D in FIG. 2 is referred to as a cartridge insertion direction D. In the present embodiment, the photoconductor cartridge B and the developing cartridge C are described as being attached to and detached from the apparatus body A in approximately the same direction perpendicular to a reference axis direction X, that is, right and left sides of FIG. 1, but the attachment/detachment direction can be varied arbitrarily.

The apparatus body A includes a driven-side plate 15 which is opposed to the photoconductor cartridge B and the developing cartridge C in the attached state from a drive side in the reference axis direction X, and a non-driven-side plate 16 which is opposed from a non-drive side thereto. A guide member described later for supporting attachment and detachment of the photoconductor cartridge B is attached to the driven-side plate 15 and the non-driven-side plate 16. Further, a tray 18 for supporting attachment and detachment of the developing cartridge C is arranged removably from the apparatus body A through the cartridge insertion port 17.

Figure 4:
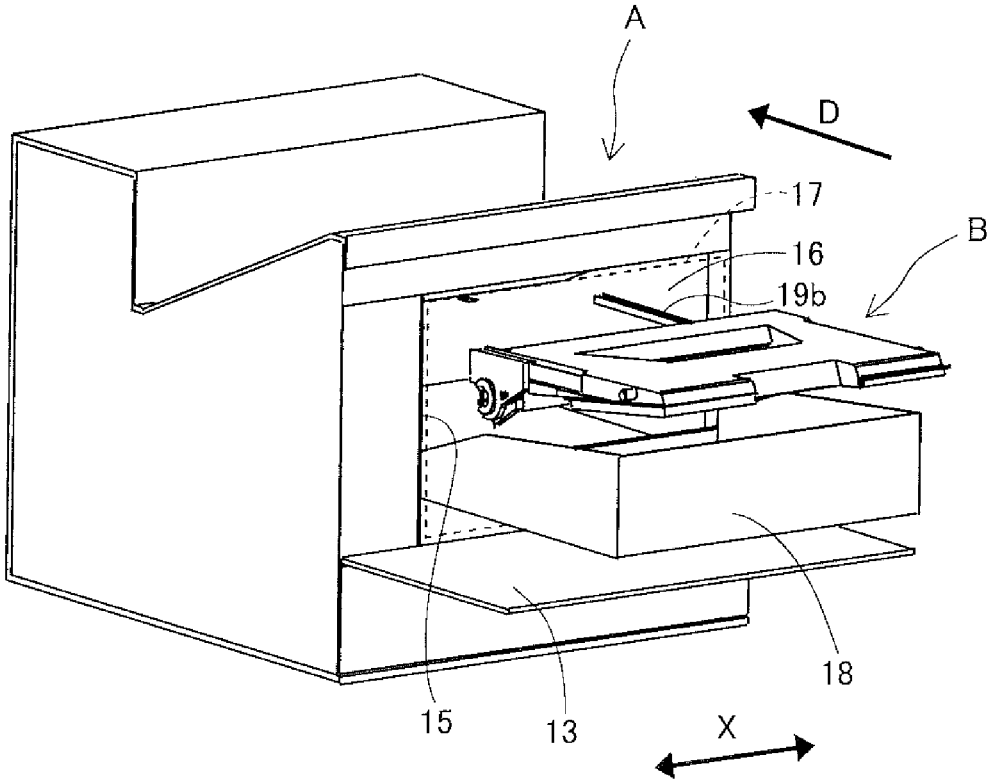
FIG. 4 is a perspective view of the apparatus body and a photoconductor cartridge according to the first embodiment.

At first, an attachment and detachment configuration of the photoconductor cartridge B will be described. As illustrated in FIG. 2, a portion 23*p* that overlaps with the photoconductor cartridge B when viewed in an insertion direction D of the cartridge is provided on the developing cartridge C. The portion 23*p* is shaped so that an upper surface of the developer container 23 is protruded upward at a portion upstream of the photoconductor cartridge B in the insertion direction D. Further, the portion 23*p* is at a planar position that differs from that of the photoconductor cartridge B, and is overlapped with the photoconductor cartridge B in terms of positions in a vertical direction (i.e., gravity direction). Thereby, the photoconductor cartridge B is restricted from being attached and detached in a state where the developing cartridge C has been attached to the apparatus body A, and as illustrated in FIG. 4, it can be attached to and detached from the apparatus boy A in a state where the developing cartridge C is not attached. A capacity of the developer container 23 can be increased by utilizing a space that overlaps with the photoconductor cartridge B when viewed in the insertion direction D by the portion 23*p*, and amount of toner filled in the toner chamber 29 in a new state and/or a capacity of a waste toner chamber 30 described later can be set high.

Figure 5:
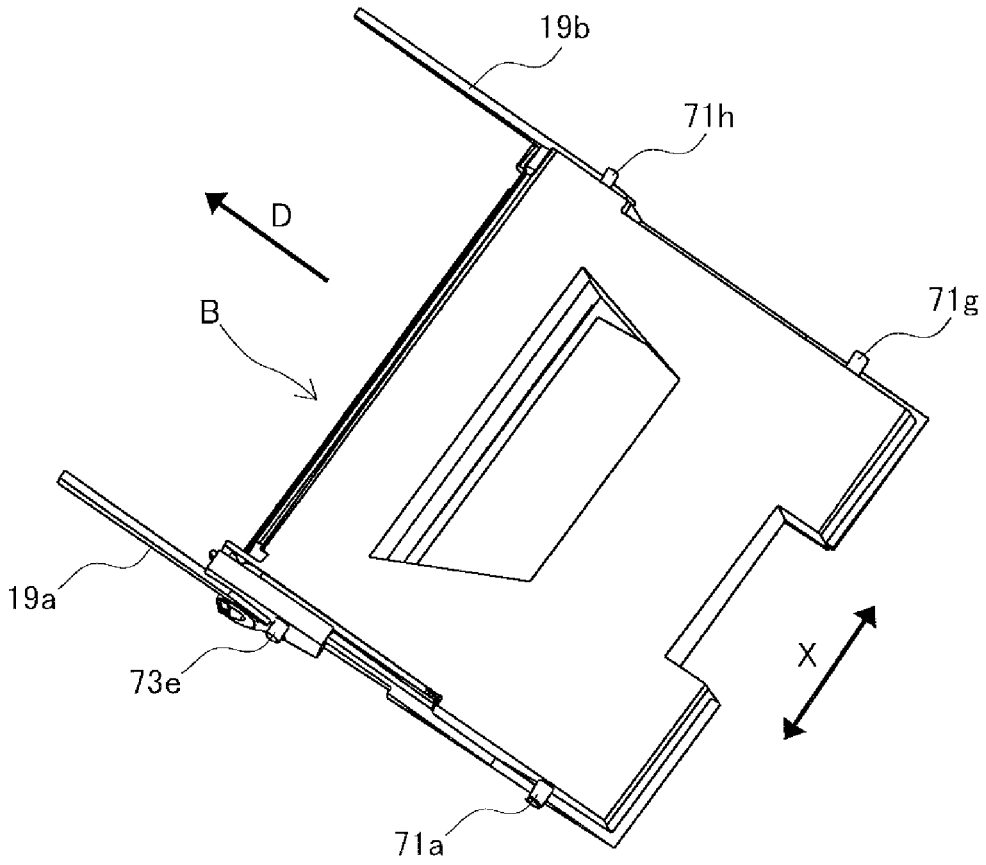
FIG. 5 is a perspective view of the photoconductor cartridge and a guide member of the apparatus body according to the first embodiment.

FIG. 5 is a perspective view illustrating a guide configuration for guiding the insertion of the photoconductor cartridge B with respect to the apparatus body A. Guide members 19*a* and 19*b* serving as a guide unit according to the present embodiment are provided on the apparatus body A (refer further to FIG. 3). First guided portions 73*e* and 71*h* and second guided portions 71*a* and 71*g* guided by the guide members 19*a* and 19*b* are provided on the photoconductor cartridge B. The first guided portions 73*e* and 71*h* are arranged on both sides of the cartridge in the reference axis direction X, and the second guided portions 71*a* and 71*g* are also provided on both sides of the cartridge in the reference axis direction X. With respect to the insertion direction D, the first guided portions 73*e* and 71*h* are positioned downstream of the second guided portions 71*a* and 71*g*. These guided portions in the present embodiment are both shaft members, i.e., boss shaped members, that protrude to the reference axis direction X from the side surface of the cartridge.

Figure 6A:
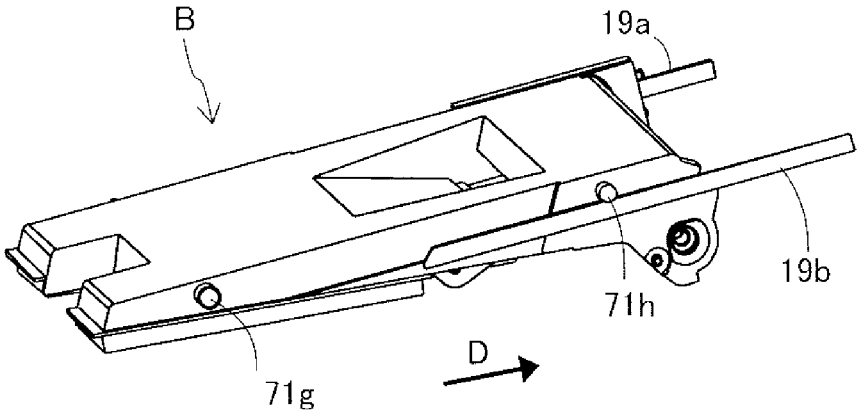
FIG. 6A is a view illustrating an insertion operation of the photoconductor cartridge according to the first embodiment.
Figure 6B:
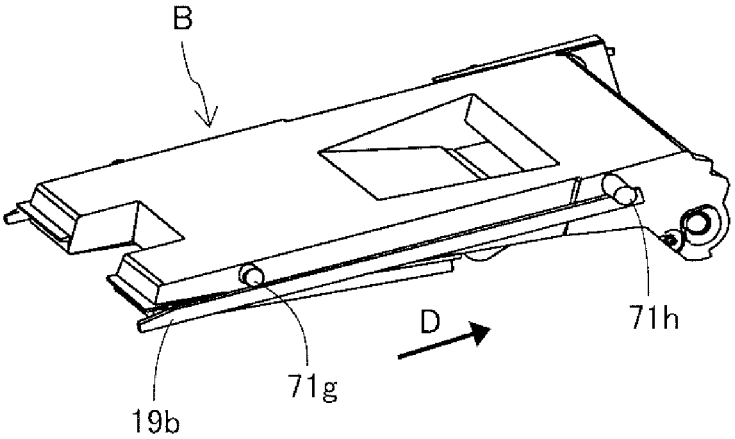
FIG. 6B is a view illustrating an insertion operation of the photoconductor cartridge according to the first embodiment.
Figure 6C:
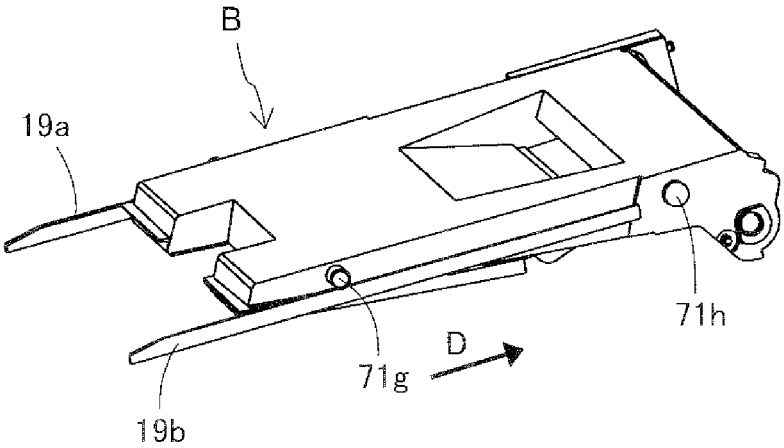
FIG. 6C is a view illustrating an insertion operation of the photoconductor cartridge according to the first embodiment.

FIGS. 6A to 6C illustrate an operation of the guide members 19*a* and 19*b* in a state where the photoconductor cartridge B is attached to the apparatus body A. The driven-side guide member 19*a* and corresponding guided portions 73*e* and 71*a* are not shown, but an operation similar to the operation of the non-drive side described later is performed. First, an operator such as a user or a maintenance staff inserts the photoconductor cartridge B in the insertion direction D so that the first guided portions 73*e* and 71*h* contact an upper surface of the guide members 19*a* and 19*b* (FIG. 6A). Further, the operator inserts the photoconductor cartridge B along the guide member 19*b*, by which both the first guided portion 71*h* and the second guided portion 71*g* contact the guide member 19*b* and are guided in the insertion direction D (FIG. 6B).

Furthermore, the photoconductor cartridge B is inserted and the first guided portion 71*h* gets apart from the guide member 19*b*. At approximately the same timing, the first guided portion 73*e* on the drive side gets apart from the guide member 19*a*. Since the first guided portions 73*e* and 71*h* leave the guide members 19*a* and 19*b*, the photoconductor cartridge B swings downward by its own weight around the second guided portions 71*a* and 71*g* supported by the guide members 19*a* and 19*b*.

As described later, a drive shaft support member 1 that supports a drive side end portion of the photoconductor cartridge B and a non-drive side support member 12 that supports anon-drive side end portion of the photoconductor cartridge B are provided on the apparatus body A. Regarding the position of the photoconductor cartridge B in the insertion direction D, a range in which the guide members 19*a* and 19*b* can support the first guided portions 73*e* and 71*h* partially overlaps with a range in which the drive shaft support member 1 and the non-drive side support member 12 can support the photoconductor cartridge B. Actually, the range in which the drive shaft support member 1 and the non-drive side support member 12 can support the photoconductor cartridge B refers to a range in which second support portions 1*b* and 12*b* of the respective support members 1 and 12 can support supported portions 73*d* and 71*f* of the photoconductor cartridge B in FIGS. 15 and 16. The drive shaft support member 1 and the non-drive side support member 12 will be described in detail later.

Accordingly, in a state where the first guided portions 73*e* and 71*h* have gotten apart from the guide members 19*a* and 19*b*, the photoconductor cartridge B will be in a state supported by the drive shaft support member 1 and the non-drive side support member 12 on the downstream side of the insertion direction D. In this state, the second guided portions 71*a* and 71*g* are supported by the guide members 19*a* and 19*b* at a side upstream of the insertion direction D. Then, when the photoconductor cartridge B is further inserted and reaches a predetermined attachment position with respect to the apparatus body A, the photoconductor cartridge B is positioned with respect to the apparatus body A and in a state coupled to a driving source of the apparatus body A (FIG. 6C). The positioning configuration and the drive transmission configuration of the photoconductor cartridge B will be described later.

Figure 7A:
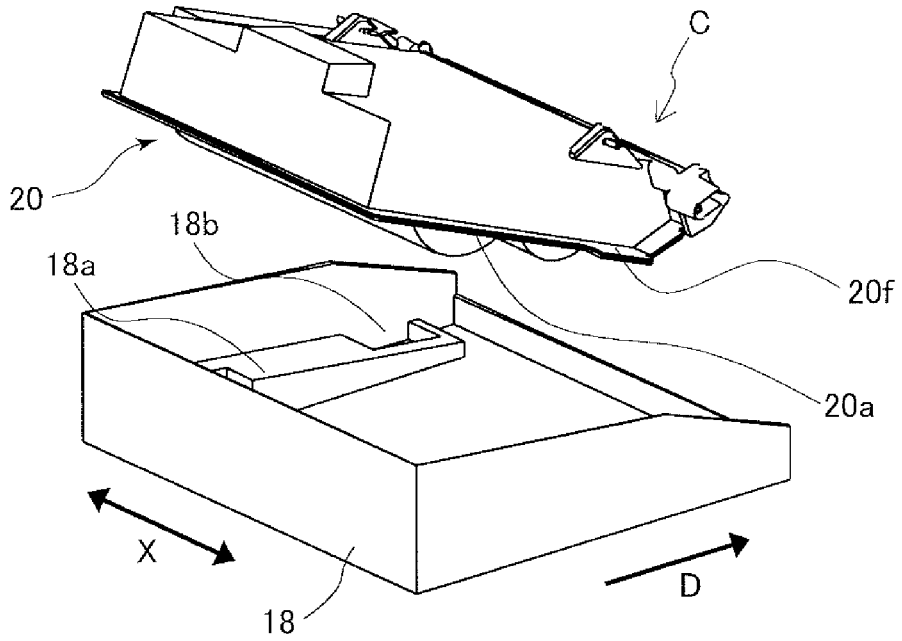
FIG. 7A is a perspective view of a developing cartridge and a tray according to the first embodiment.
Figure 7B:
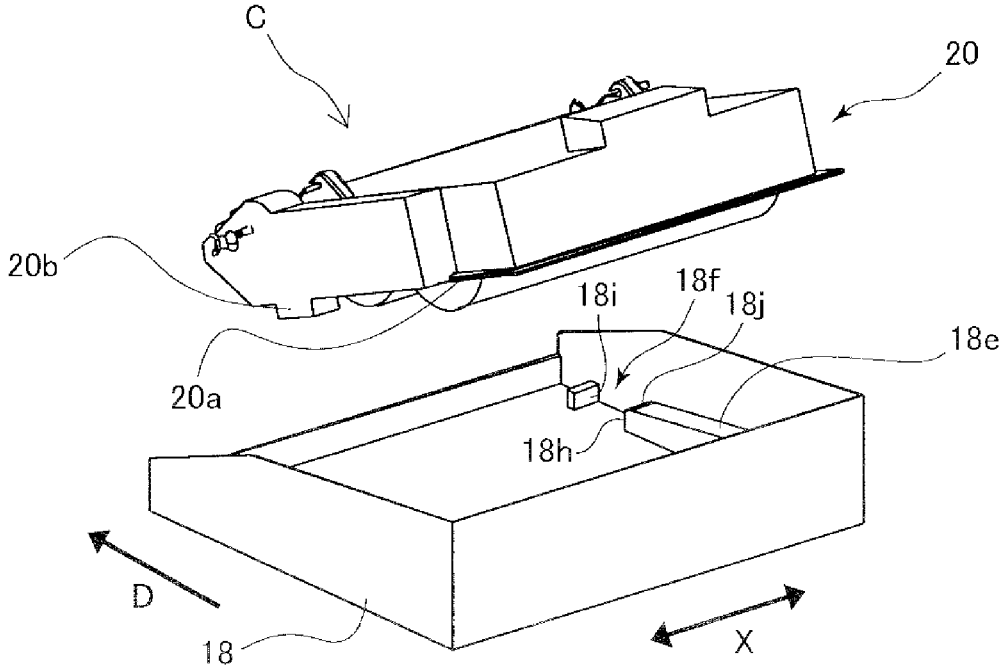
FIG. 7B is a perspective view of a developing cartridge and a tray according to the first embodiment.

Next, an attachment and detachment configuration of the developing cartridge C will be described. As illustrated in FIGS. 7A and 7B, the attachment and detachment of the developing cartridge C is performed in a state loaded (supported) on the tray 18. The tray 18 serving as a drawer member according to the present embodiment is supported by a rail provided on the apparatus body A to be inserted to and drawn out the apparatus body A. The tray 18 includes supporting surfaces 18*a* and 18*e* that support a supported surface 20*a* provided on the developing cartridge C, and position regulating portions 18*b* and 18*f* that regulate the position of the developing cartridge C with respect to the tray 18. The position regulating portions 18*b* and 18*f* according to the present embodiment adopt approximately rectangular recessed shapes that are recessed downward in the vertical direction from the supporting surfaces 18*a* and 18*e*. A regulated portion 20*b* that fits to the position regulating portion 18*b* is provided at a position protruding downward with respect to the supported surface 20*a* on a driven-side end portion at the bottom surface of the developing cartridge C, as illustrated in FIG. 7B. Further, a regulated portion 20*f* that fits to the position regulating portion 18*f* is formed in a plate shape that is connected to the supported surface 20*a* at a non-drive side end portion of the developing cartridge, and formed to protrude from the supported surface 20*a* to the reference axis direction X, as illustrated in FIG. 7A.

Figure 8:
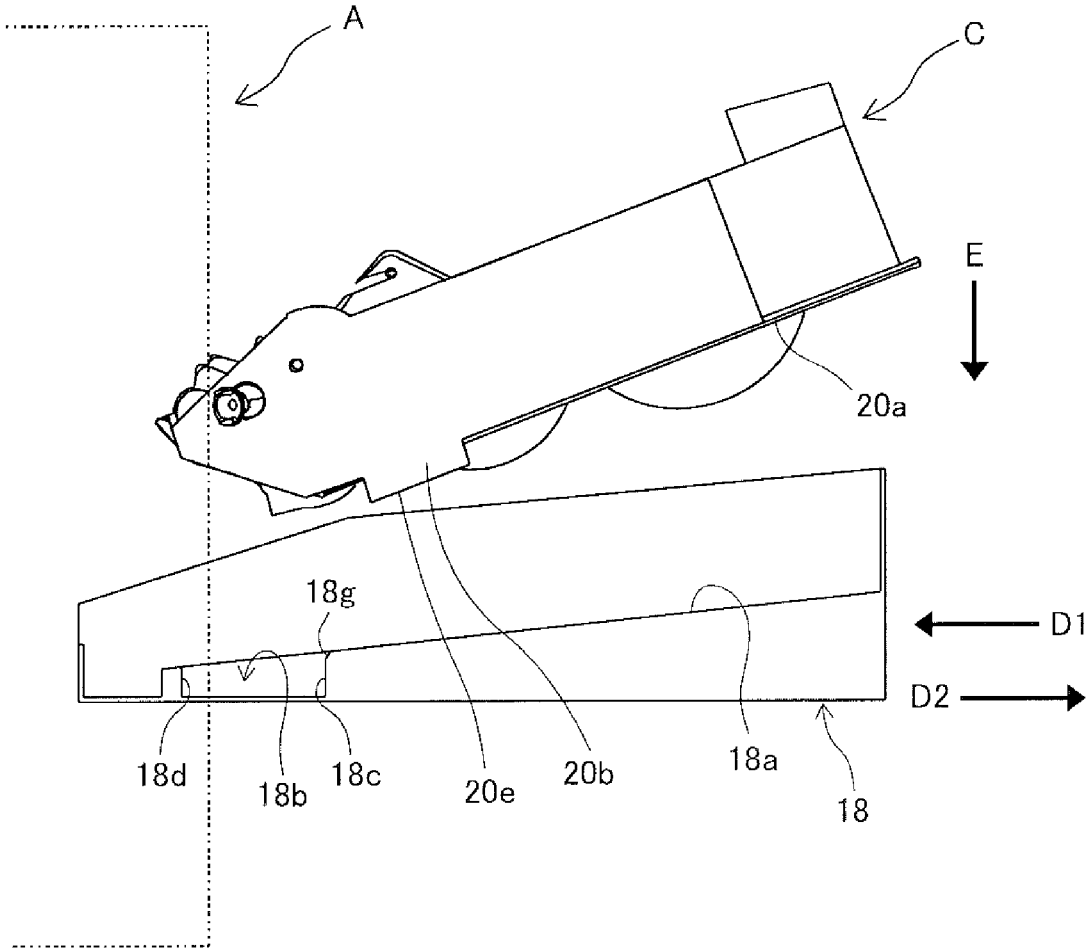
FIG. 8 is a view illustrating a state of operation in which the developing cartridge is loaded on the tray according to the first embodiment.

As illustrated in FIG. 8, the supporting surface 18*a* of the tray 18 is inclined with respect to a horizontal plane so as to extend further downward in the vertical direction as it extends downstream in the insertion direction D1 of the tray 18, which is the same direction as the insertion direction D of the developing cartridge C according to the present embodiment. The position regulating portion 18*b* includes a first regulating surface 18*c* that regulates relative movement of the regulated portion 20*b* toward a draw-out direction D2, that is, direction opposite to the insertion direction D1, with respect to the tray 18, and a second regulating surface 18*d* that regulates relative movement of the regulated portion 20*b* to the insertion direction D1 with respect to the tray 18. Further, the first regulating surface 18*c* and the supporting surface 18*a* that extend in a substantially vertical direction are connected by an inclined surface 18*g*, which is a chamfered portion.

The driven-side configuration has been described above, but the supporting surface 18*e* and the position regulating portion 18*f* on the non-drive side adopt a similar configuration. That is, as illustrated in FIG. 7B, the position regulating portion 18*f* includes a first regulating surface 18*h* that regulates relative movement of the regulated portion 20*f* of the developing cartridge C in the draw-out direction D2 with respect to the tray 18. Further, the position regulating portion 18*f* includes a second regulating surface 18*i* that regulates relative movement of the regulated portion 20*b* in the insertion direction D1 with respect to the tray 18. Further, the first regulating surface 18*h* and the supporting surface 18*e* that extend in an approximately vertical direction are connected by an inclined surface 18*j*, which is a chamfered portion.

In a state where the operator moves the tray 18 in the insertion direction D1, the developing cartridge C may receive force in the draw-out direction D2 from a member provided on the apparatus body A. Even in such a case, the first regulating surfaces 18*c* and 18*h* of the tray 18 press the regulated portions 20*b* and 20*f* of the developing cartridge C, by which the developing cartridge C moves integrally with the tray 18 in the insertion direction D1. Further, in a state where the operator moves the tray 18 in the draw-out direction D2, the developing cartridge C may receive force in the insertion direction D1 from a member provided on the apparatus body A. Even in such a case, the second regulating surfaces 18*d* and 18*i* of the tray 18 press the regulated portions 20*b* and 20*f* of the developing cartridge C, by which the developing cartridge C moves integrally with the tray 18 in the draw-out direction D2.

According to the present embodiment, a configuration example has been illustrated where the regulated portions 20*b* and 20*f* are protruded and the position regulating portions 18*b* and 18*f* are fit to the regulated portions 20*b* and 20*f*, but other configurations can be adopted to regulate relative movement of the developing cartridge C with respect to the tray 18. For example, one or more projected portions that protrude upward from a bottom surface of the tray 18 can be provided, and the developing cartridge C can be provided with recessed portions that fit to the projected portions. Even in this case, the projected portions fits to the recessed portions to regulate relative movement of the developing cartridge C to the insertion direction D1 and the draw-out direction D2 with respect to the tray 18, and the developing cartridge C can be moved along with the insertion or drawing out of the tray 18. Further, configurations corresponding to the position regulating portions 18*b* and 18*f* and the regulated portions 20*b* and 20*f* can be provided at arbitrary positions that differ from the illustrated positions in a plane coordinate of the tray 18. Similar effects can be achieved by this configuration.

FIGS. 8 to 12 illustrate a state where the operation for having the tray 18 support the developing cartridge C is viewed from the drive side in the reference axis direction X. In the following description, the operation performed at the drive side will be described, but a similar operation is also performed at the non-drive side.

Figure 9:
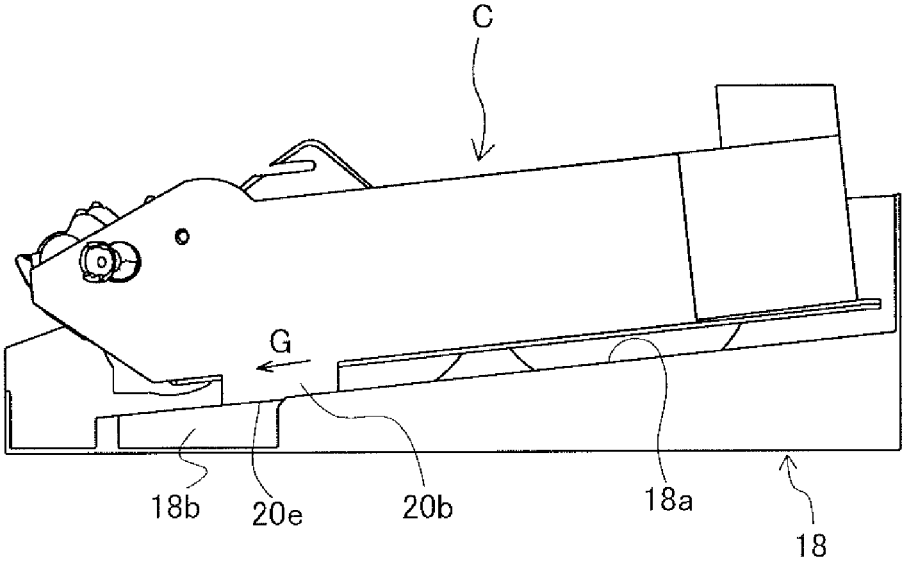
FIG. 9 is a view illustrating the state of operation in which the developing cartridge is loaded on the tray according to the first embodiment.

As illustrated in FIG. 8, the developing cartridge C is set from above to the tray 18 that has been drawn out to a predetermined position where attaching and detaching of the developing cartridge C to and from the apparatus body A is enabled. The operator lowers the cartridge from above the tray 18 downward while holding a holding part of the developing cartridge C (arrow E). Then, as illustrated in FIG. 9, a bottom surface 20*e* of the regulated portion 20*b* contacts the supporting surface 18*a* of the tray 18. Since the supporting surface 18*a* is inclined, the operator can easily move the developing cartridge C to a position where the regulated portion 20*b* fits to the position regulating portion 18*b* by sliding the developing cartridge C in a direction denoted by arrow G.

Figure 10:
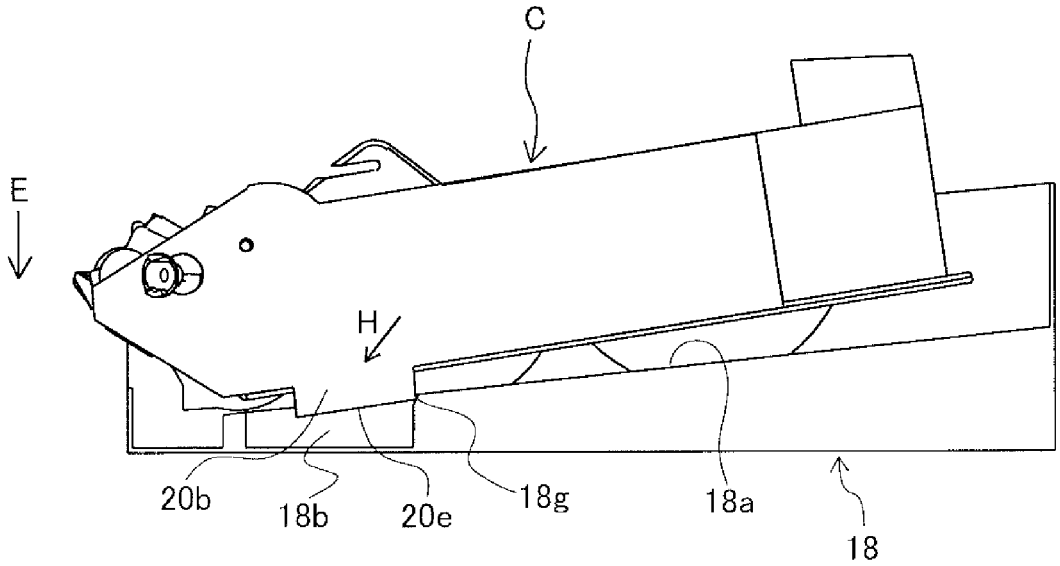
FIG. 10 is a view illustrating the state of operation in which the developing cartridge is loaded on the tray according to the first embodiment.
Figure 11:
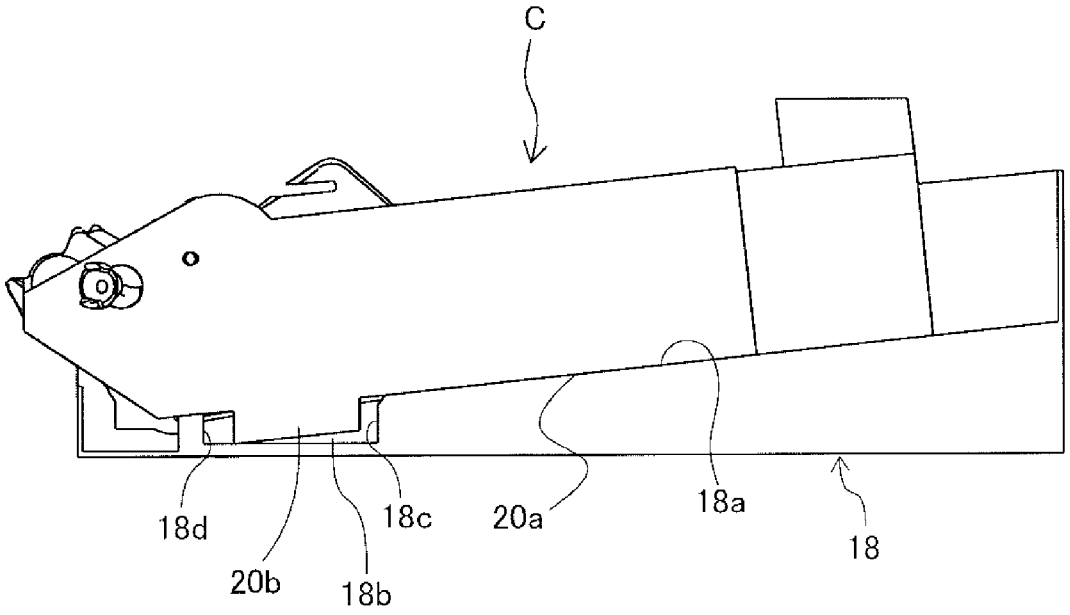
FIG. 11 is a view illustrating the state of operation in which the developing cartridge is loaded on the tray according to the first embodiment.

As illustrated in FIG. 10, when the regulated portion 20*b* approaches the position regulating portion 18*b*, the bottom surface 20*e* of the regulated portion 20*b* gets apart from the supporting surface 18*a* and contacts the inclined surface 18*g*. Since the inclination of the inclined surface 18*g* is greater than the supporting surface 18*a*, the regulated portion 20*b* slides down in an arrow H direction along the inclined surface 18*g* by the own weight of the developing cartridge C, and the regulated portion 20*b* gets apart from the inclined surface 18*g* and falls in a direction denoted by arrow E. As a result, as illustrated in FIG. 11, the regulated portion 20*b* of the developing cartridge C fits to the position regulating portion 18*b* and the supported surface 20*a* is supported by the supporting surface 18*a*, by which the setting of the developing cartridge C to the tray 18 is completed. In the state illustrated in FIG. 11, the weight of the developing cartridge C is supported via the tray 18 by the apparatus body A, and movement of the developing cartridge C in a horizontal direction with respect to the tray 18 is regulated.

Thereafter, the developing cartridge C loaded on the tray 18 is inserted in the insertion direction D1 so as to be attached to the apparatus body A. As described earlier, the photoconductor cartridge B is configured to be attached to and detached from the apparatus body A in a state where the developing cartridge C is not attached. Therefore, the attachment operation of the developing cartridge C is normally performed in a state where the photoconductor cartridge B has been attached to the apparatus body A.

Supporting Configuration of Cartridge

Next, a supporting configuration of the photoconductor cartridge B and the developing cartridge C in a state attached to the apparatus body A will be described. While being attached to the apparatus body A, the photoconductor cartridge B is supported by the driven-side plate 15 and the non-driven-side plate 16 (FIG. 3) of the apparatus body A.

Figure 15:
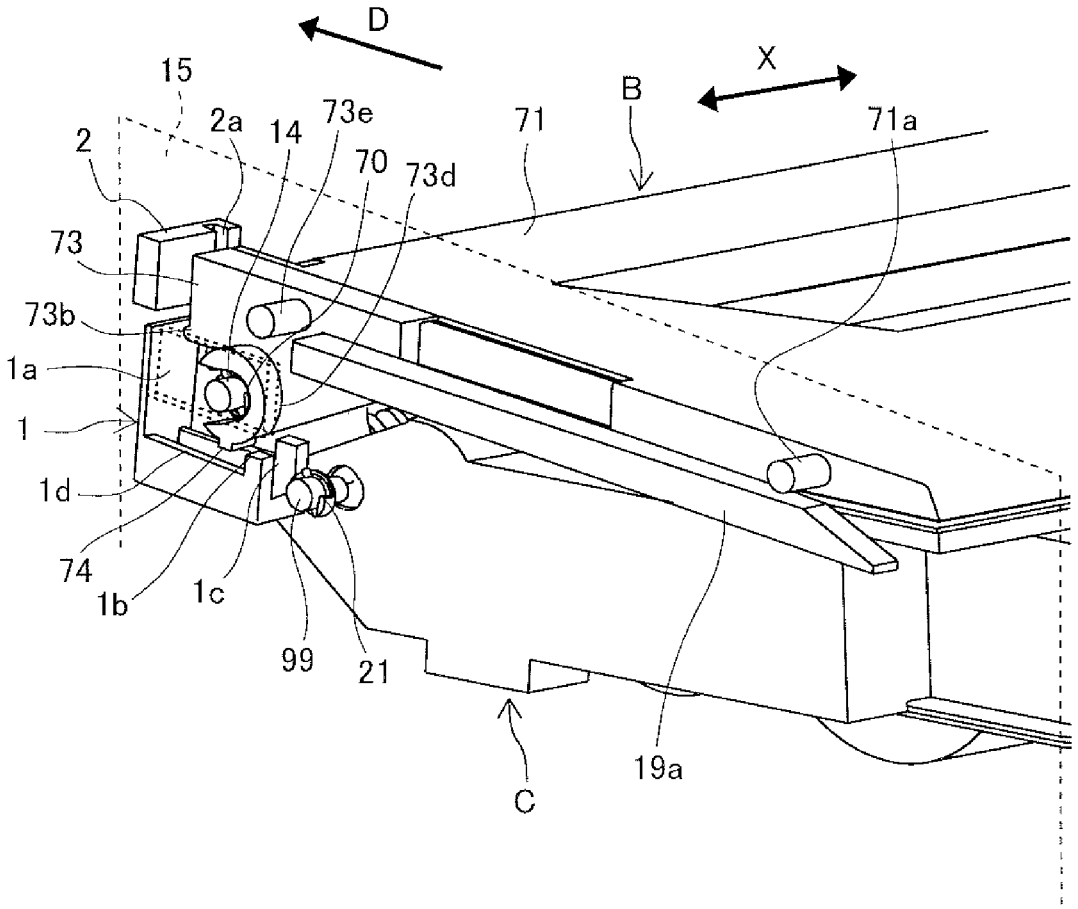
FIG. 15 is a view illustrating a supporting configuration of the photoconductor cartridge according to the first embodiment.

As illustrated in FIG. 15, the drive shaft support member 1 and the above-mentioned guide member 19*a* are provided on the driven-side plate 15. The drive shaft support member 1 is a member in which a first supporting portion 1*a*, a second supporting portion 1*b*, a guide groove 1*c* and a cutout portion 1*d* are integrally formed, and it rotatably supports a first drive shaft 14 described later. A first supported portion 73*b* supported by the first supporting portion 1*a* and a second supported portion 73*d* supported by the second supporting portion 1*b* are provided on the drum bearing 73 of the photoconductor cartridge B. On the drive side of the reference axis direction X, the photoconductor cartridge B in the attached state is supported by the apparatus body A in a state where the first supported portion 73*b*, the second supported portion 73*d* and the second guided portion 71*a* are respectively in contact with the first supporting portion 1*a*, the second supporting portion 1*b* and the guide member 19*a*. The guide groove 1*c* and the cutout portion 1*d* of the drive shaft support member 1 will be described later.

Figure 16:
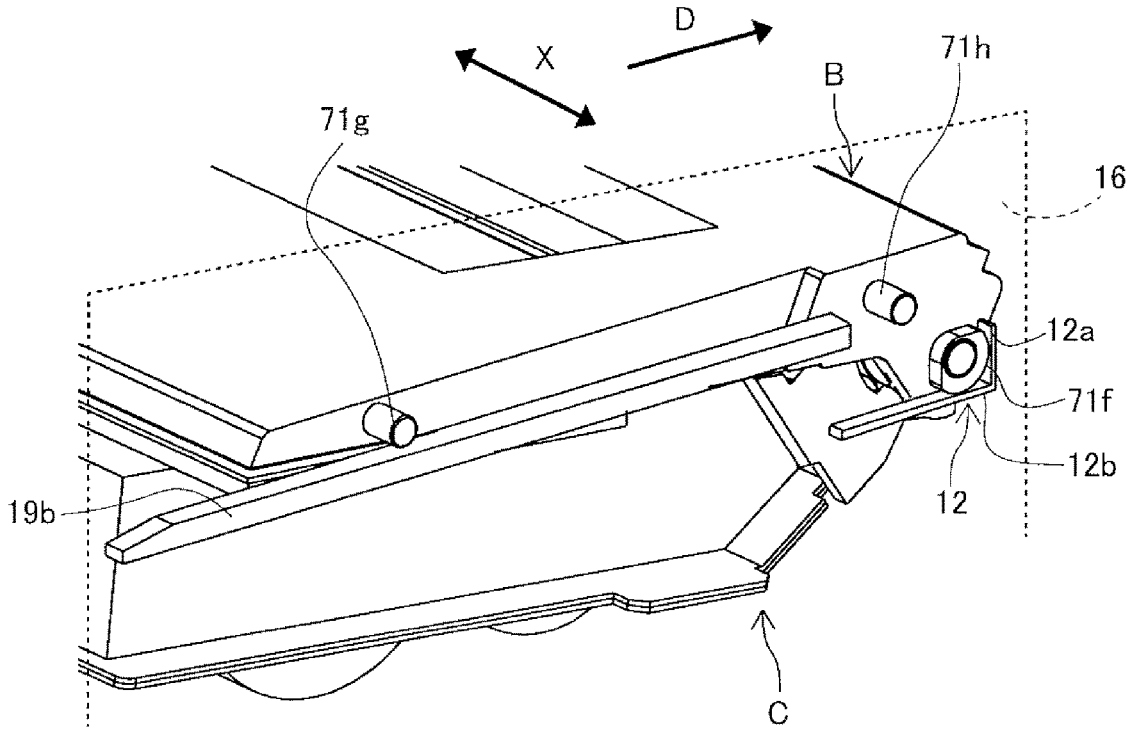
FIG. 16 is a view illustrating the supporting configuration of the photoconductor cartridge according to the first embodiment.

Further, as illustrated in FIG. 16, the non-drive side support member 12 and the guide member 19*b* are provided on the non-driven-side plate 16. The non-drive side support member 12 includes a first supporting portion 12*a* and a second supporting portion 12*b*. A projection 71*f* supported by the first supporting portion 12*a* and the second supporting portion 12*b* are provided on the cleaning frame member 71 of the photoconductor cartridge B. On the non-drive side of the reference axis direction X, the photoconductor cartridge B in the attached state is supported by the apparatus body A in a state where the projection 71*f* is in contact with the first supporting portion 12*a* and the second supporting portion 12*b* and where the second guided portion 71*g* is in contact with the guide member 19*a*.

Figure 18:
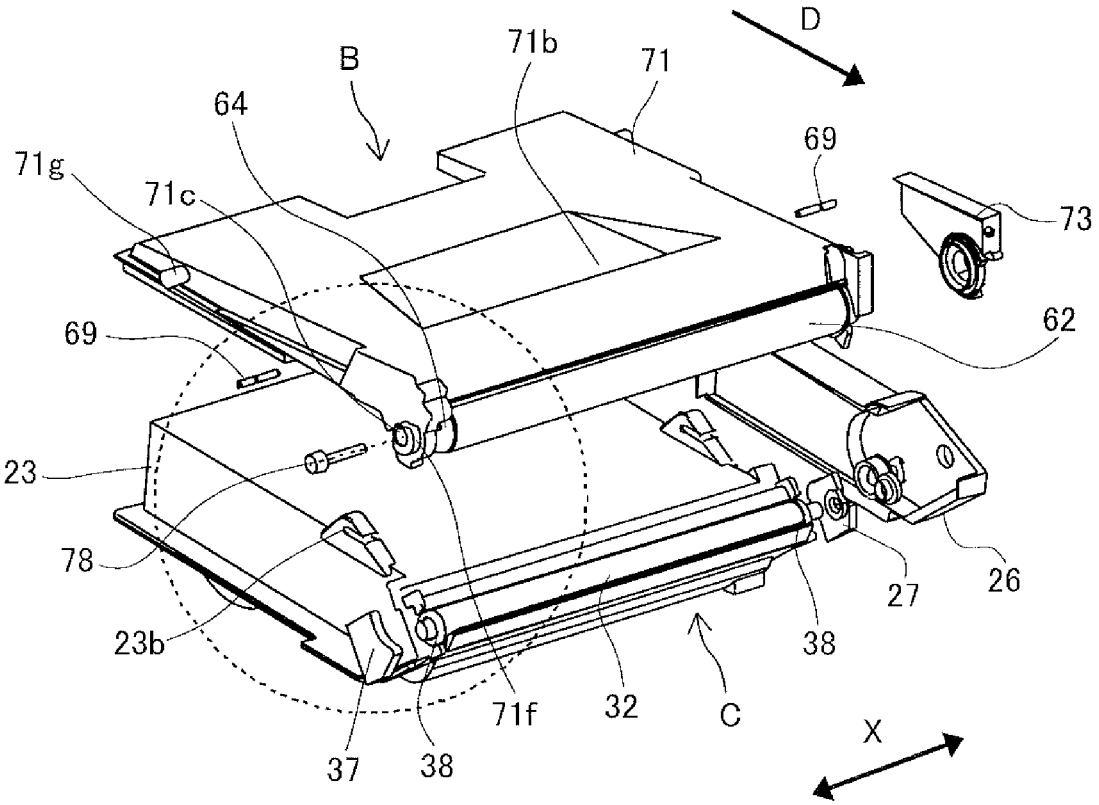
FIG. 18 is an exploded view of a process unit according to the first embodiment.
Figure 20:
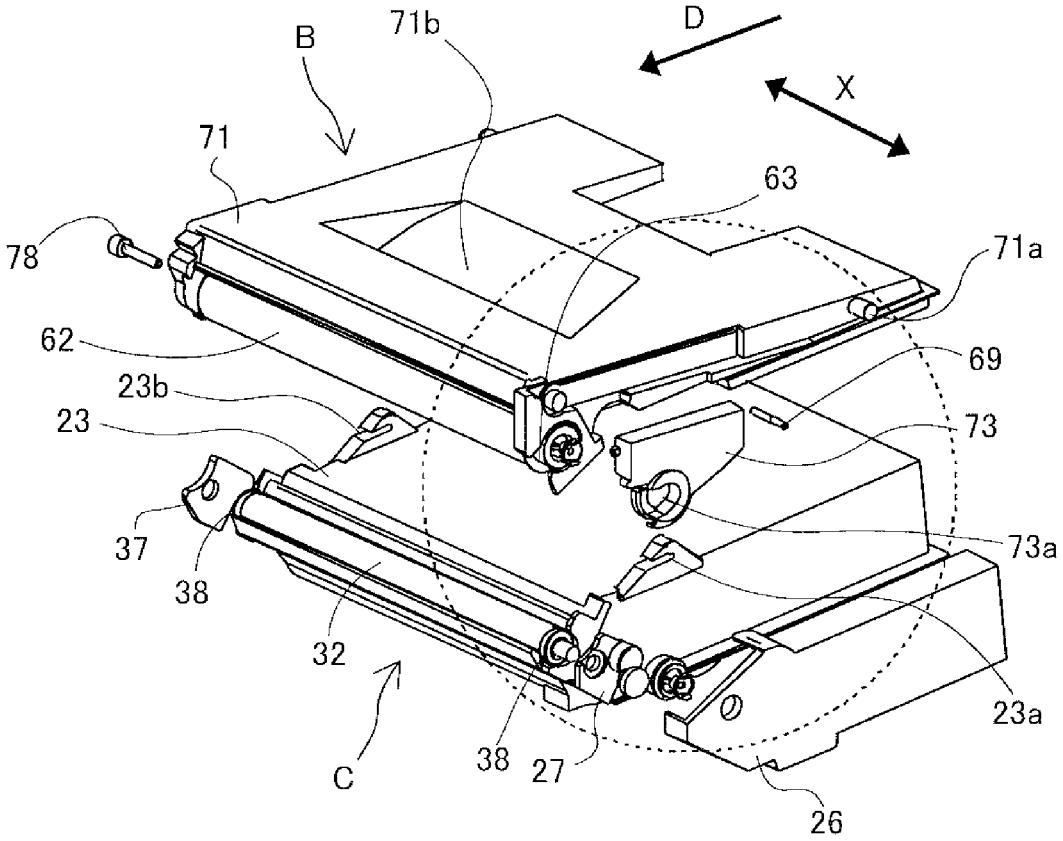
FIG. 20 is an exploded view of the process unit according to the first embodiment.

Next, a supporting configuration of the developing cartridge C will be described. As illustrated in FIGS. 18 and 20, a first support hole 23*a* and a second support hole 23*b* are provided at both ends of the developing cartridge C in the reference axis direction X. The first support hole 23*a* and the second support hole 23*b* serving as engaged portions according to the present embodiment are formed on the developer container 23 in forms of grooves (or cut-outs) that extend in the insertion direction D of the cartridge. The detailed orientation of the groove shapes will be described later.

As illustrated in FIGS. 19 and 21, first suspended holes 71*i* and 71*i* and second suspended holes 71*j* and 71*j* are provided at both end portions in the reference axis direction X of the photoconductor cartridge B, and coupling pins 69 and 69 are respectively press-fit to the first suspended holes 71*i* and the second suspended holes 71*j*. Note that FIG. 19 is a perspective view in which a portion denoted by a circle in FIG. 18 is viewed from a lower side, and FIG. 21 is a perspective view in which a portion denoted by a circle in FIG. 20 is viewed from a lower side. The coupling pin 69 is each a shaft member that extends in the reference axis direction X. The coupling pins 69 and 69 each serve as an engagement portion engaged to the first support hole 23*a* and the second support hole 23*b* according to the present embodiment.

Figure 12:
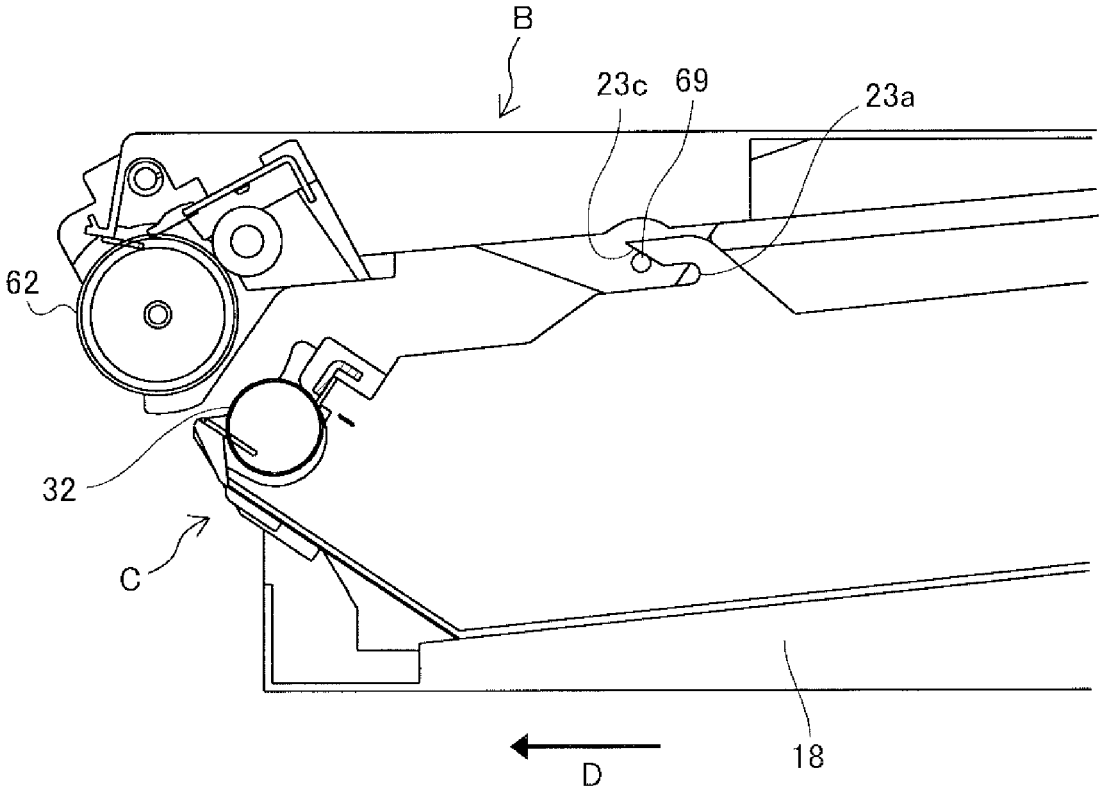
FIG. 12 is a view illustrating an engagement of the developing cartridge and the photoconductor cartridge according to the first embodiment.
Figure 13:
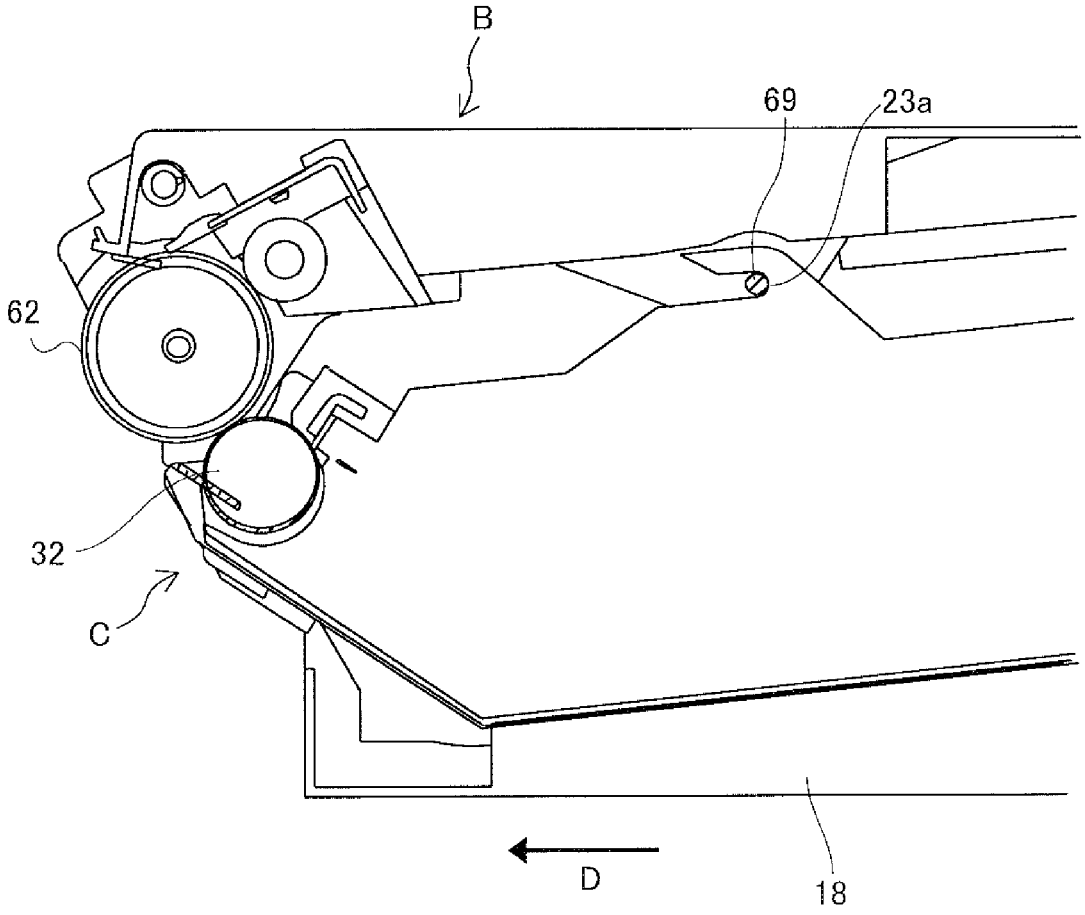
FIG. 13 is a view illustrating the engagement of the developing cartridge and the photoconductor cartridge according to the first embodiment.
Figure 14:
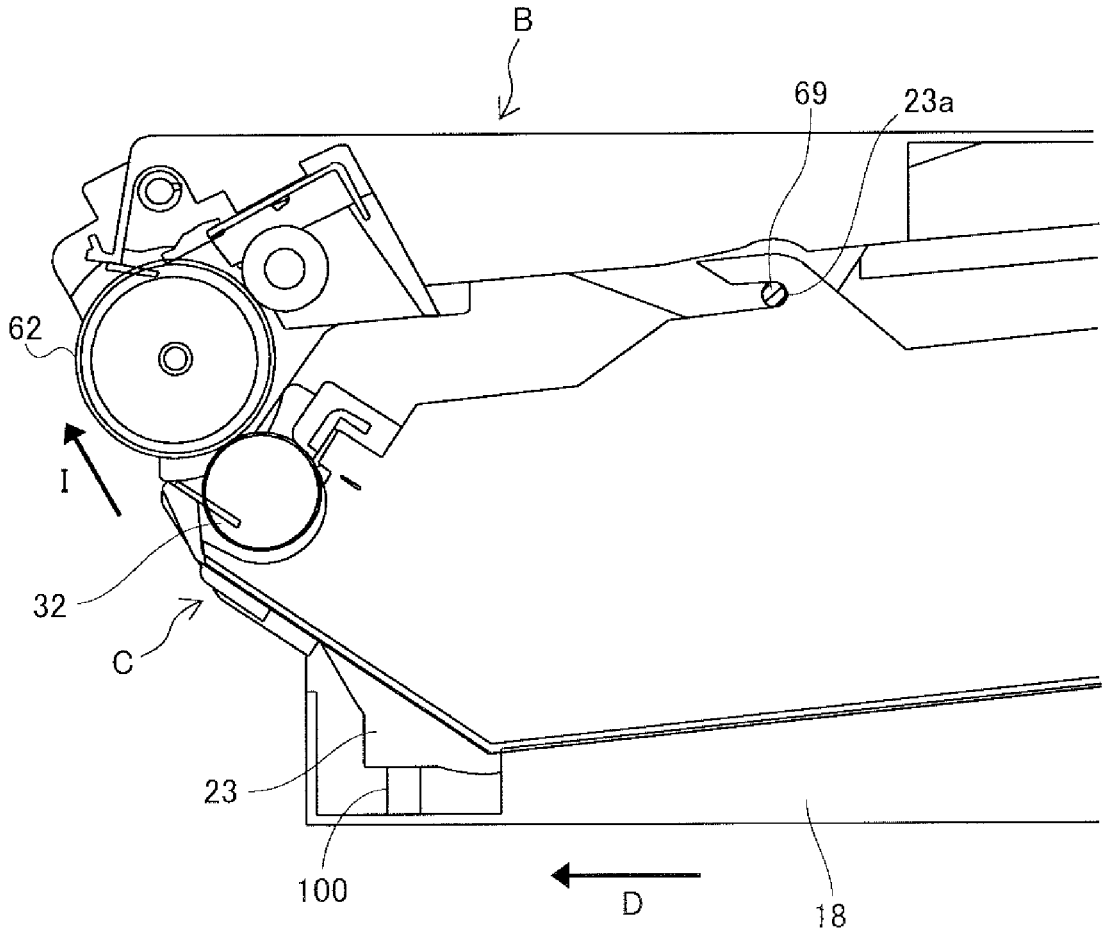
FIG. 14 is a view illustrating the engagement of the developing cartridge and the photoconductor cartridge according to the first embodiment.

FIGS. 12 to 14 respectively illustrate a state where the developing cartridge C and the photoconductor cartridge B are engaged during a process in which the developing cartridge C is inserted to the apparatus body A. Hereafter, the operation viewed from the drive side in the reference axis direction X will be described, but a similar operation is also realized on the non-drive side by the second support hole 23*b* and the coupling pin 69.

As described above, the developing cartridge C is inserted together with the tray 18 to the apparatus body A in the insertion direction D in a state being placed on the tray 18. As illustrated in FIG. 12, an inclined surface 23*c* is formed on an opening portion of the first support hole 23*a*, and when the developing cartridge C is inserted, the inclined surface 23*c* initially contacts the coupling pin 69 of the photoconductor cartridge B.

The inclined surface 23*c* is inclined with respect to a horizontal plane so as to extend upward in the vertical direction toward a downstream side in the insertion direction D. Therefore, if the developing cartridge C is further inserted after the inclined surface 23*c* contacts the coupling pin 69, the inclined surface 23*c* rides on the coupling pin 69 and the developing cartridge C lifts up. Then, as illustrated in FIG. 13, the first support hole 23*a* will be engaged to the coupling pin 69, that is, an area close to the bottom of the groove-shaped hole than the inclined surface 23*c* is in contact with the coupling pin 69. Simultaneously, on the opposite side in the reference axis direction X, the second support hole 23*b* contacts the coupling pin 69 at the inclined surface 23*c* before being engaged with the coupling pin 69.

In the state where the first support hole 23*a* and the second support hole 23*b* are engaged with the coupling pin 69, at least a portion of the weight of the developing cartridge C will be supported by the photoconductor cartridge B through the coupling pin 69. The developing cartridge C is capable of swinging in a direction in which the developing roller 32 moves toward and away from the photosensitive drum 62 while the coupling pin 69 acting as a fulcrum. As illustrated in FIG. 14, in a state where an urging member 100 provided on the tray 18 pushes a bottom surface, that is, bottom portion, of the developer container 23 of the developing cartridge C upward, the developing roller 32 receives urging force in an I direction around the coupling pin 69. Thereby, the gap retainer 38 mentioned above contacts the photosensitive drum 62, and the developing roller 32 is positioned with respect to the photosensitive drum 62. The urging member 100 serving as an urging portion according to the present embodiment is a spring member provided on a bottom portion of the tray 18, for example.

In a state where the developing cartridge C moves by having the inclined surface 23*c* of the first support hole 23*a* and the second support hole 23*b* ride on the coupling pin 69, the coupling pin 69 pushes back the inclined surface 23*c*, by which a force opposite to the insertion direction D acts on the developing cartridge C. However, as described above, since the first regulating surfaces 18*c* and 18*h* of the position regulating portions 18*b* and 18*f* provided on the tray 18 push the regulated portions 20*b* and 20*f* of the developing cartridge C in the insertion direction D, the developing cartridge C can move to the insertion direction D together with the tray 18. The fitting length in the up-down direction of the first regulating surfaces 18*c* and 18*h* and the regulated portions 20*b* and 20*f* is set so that the first regulating surfaces 18*c* and 18*h* maintain contact with the regulated portions 20*b* and 20*f* even in a state where the inclined surface 23*c* rides on the coupling pin 69.

When drawing out the tray 18, in a state where the coupling pin 69 is withdrawn from the first support hole 23*a* and the second support hole 23*b*, a force in the insertion direction D that is opposite to the draw-out direction acts on the developing cartridge C. However, as described above, the second regulating surfaces 18*d* and 18*i* of the position regulating portions 18*b* and 18*f* provided on the tray 18 push the regulated portions 20*b* and 20*f* of the developing cartridge C in the draw-out direction, the developing cartridge C can move to the draw-out direction together with the tray 18. The fitting length in the up-down direction of the second regulating surfaces 18*d* and 18*i* and the regulated portions 20*b* and 20*f* is set so that the second regulating surfaces 18*d* and 18*i* maintain contact with the regulated portions 20*b* and 20*f* while the coupling pin 69 is withdrawn from the first support hole 23*a* and the second support hole 23*b*.

As described, according to the present embodiment, the attachment and detachment of the photoconductor cartridge B is guided by the guide members 19*a* and 19*b* and the attachment and detachment of the developing cartridge C is performed in a state supported by the tray 18. Then, by inserting the tray 18 supporting the developing cartridge C in a direction intersecting the reference axis direction X, that is, the insertion direction D, the developing cartridge C is engaged with the photoconductor cartridge B attached to the apparatus body A. That is, the replacement operation of the cartridges is facilitated in a configuration where the image forming unit is composed of a plurality of cartridges, and an image forming unit and an image forming apparatus having a high usability can be provided.

In the present embodiment, the urging member 100 is provided on the tray 18, but the urging member can be arranged at a different location, as long as it is arranged to apply force in a direction abutting the developing roller against the photosensitive drum. The groove shape of the first support hole 23*a* and the second support hole 23*b* is preferably somewhat inclined with respect to the horizontal plane so that it rises in the vertical direction as it extends upstream in the insertion direction D, as according to the present embodiment. Thereby, it becomes possible to prevent respective support holes engaged to the coupling pin 69 from slipping out of the coupling pin 69. Furthermore, it becomes possible to prevent slipping even further by arranging the position of the developing cartridge C in a state where the first support hole 23*a* and the second support hole 23*b* are engaged with the coupling pin 69 so that the first support hole 23*a* urges the coupling pin 69 by gravity acting on the developing cartridge C.

Further, the urging member 100 should preferably be rounded at the end portion on the upstream side in the insertion direction D of the tray 18. Thereby, the developing cartridge C can easily ride on the urging member 100 along with the operation for inserting the tray 18 to the apparatus body A.

According to the present embodiment, the developing cartridge C is designed to ride on the urging member 100 along with the insertion operation of the tray 18, but as another example, the urging member may urge the developing cartridge C by performing a predetermined operation after the insertion operation of the tray 18. For example, an opening portion through which the urging member 100 can pass may be formed on the bottom surface of the tray 18, and at the same time, the urging member 100 may be designed to move in linkage with the opening and closing of the door 13 (FIG. 3). Then, after inserting the tray 18, the door 13 is closed so that the urging member 100 can move to a position in contact with the developing cartridge C through the opening portion of the tray 18. Further, by opening the door 13, the urging member 100 can be retreated through the opening portion of the tray 18 to a position not interfering with the drawing out of the tray 18 and the developing cartridge C.

Input of Drive to Cartridge

Next, a configuration for entering drive (driving force) from the apparatus body A to the photoconductor cartridge B will be described. As illustrated in FIG. 15, a drum coupling 70 and a developing coupling 21 are provided on the driven-side side surface in the reference axis direction X of the photoconductor cartridge B and the developing cartridge C for receiving driving force from the apparatus body A. The drum coupling 70 constitutes a first connecting portion that connects to the first drive shaft 14 of the apparatus body A serving as a first shaft member, and the developing coupling 21 constitutes a second connecting portion that connects to a second drive shaft 99 of the apparatus body A serving as a second shaft member. The drum coupling 70 according to the present embodiment is arranged coaxially with the photosensitive drum 62 (refer to FIG. 21), and the drum coupling 70 together with the photosensitive drum 62 constitute a drum unit that rotates integrally and that is supported rotatably by the drum bearing 73.

The drum coupling 70 and the developing coupling 21 adopt a configuration where they can both be tilted (inclined) with respect to the photoconductor cartridge B and the developing cartridge C, in other words, so that the rotational axis of the coupling member can be inclined with respect to the reference axis direction X. As described below, the drum coupling 70 and the developing coupling 21 are configured to be engaged with or withdrawn from the first drive shaft 14 and the second drive shaft 99 along with the operation in which the photoconductor cartridge B and the developing cartridge C are inserted to and drawn out of the apparatus body A.

As illustrated in FIG. 23A, in a state where the photoconductor cartridge B is not attached to the apparatus body A, the drum coupling 70 is urged so that a tip is oriented downstream in the insertion direction D by a helical torsion spring 24 serving as a first urging member. As illustrated in FIG. 23B, in a state where the photoconductor cartridge B is inserted to the apparatus body A, the drum coupling 70 is engaged with the first drive shaft 14 before the photoconductor cartridge B reaches the attachment position. That is, a key 14*a* provided on the first drive shaft 14 fits to a key groove 70*a* of the drum coupling 70, and along with the rotation of the first drive shaft 14, the drum coupling 70 will be in a rotatable state. Then, in a state where the drum coupling 70 is pressed by the first drive shaft 14 against the urging force of the helical torsion spring 24, the drum coupling 70 is substantially extended in the reference axis direction X in a state where the photoconductor cartridge B has reached the attachment position.

Similarly, as illustrated in FIG. 23C, in a state where the developing cartridge C is not attached to the apparatus body A, the developing coupling 21 is urged so that a tip is oriented downstream in the insertion direction D by a helical torsion spring 25 serving as a second urging member. As illustrated in FIG. 23D, in a state where the developing cartridge C is inserted to the apparatus body A, the developing coupling 21 is engaged with the second drive shaft 99 before the developing cartridge C reaches the attachment position. That is, a key 99*a* provided on the second drive shaft 99 fits to a key groove 21*a* of the developing coupling 21, and along with the rotation of the second drive shaft 99, the developing coupling 21 will be in a rotatable state. Then, in a state where the developing coupling 21 is pressed by the second drive shaft 99 against the urging force of the helical torsion spring 25, the developing coupling 21 will substantially be extended in the reference axis direction X in a state where the developing cartridge C has reached the attachment position.

In the state illustrated in FIG. 23D, the photoconductor cartridge B and the developing cartridge C are respectively capable of receiving driving force from the apparatus body A through the drum coupling 70 and the developing coupling 21. As described above, since a coupling member capable of tilting (being inclined) with respect to the reference axis direction X is provided, it becomes possible to smoothly connect (engage) and disconnect (disengage) drive transmission of the cartridge and the apparatus body by inserting the cartridge to the apparatus body or drawing the cartridge out of the apparatus body.

Positioning of Photosensitive Drum in Axial Direction

Figure 22:
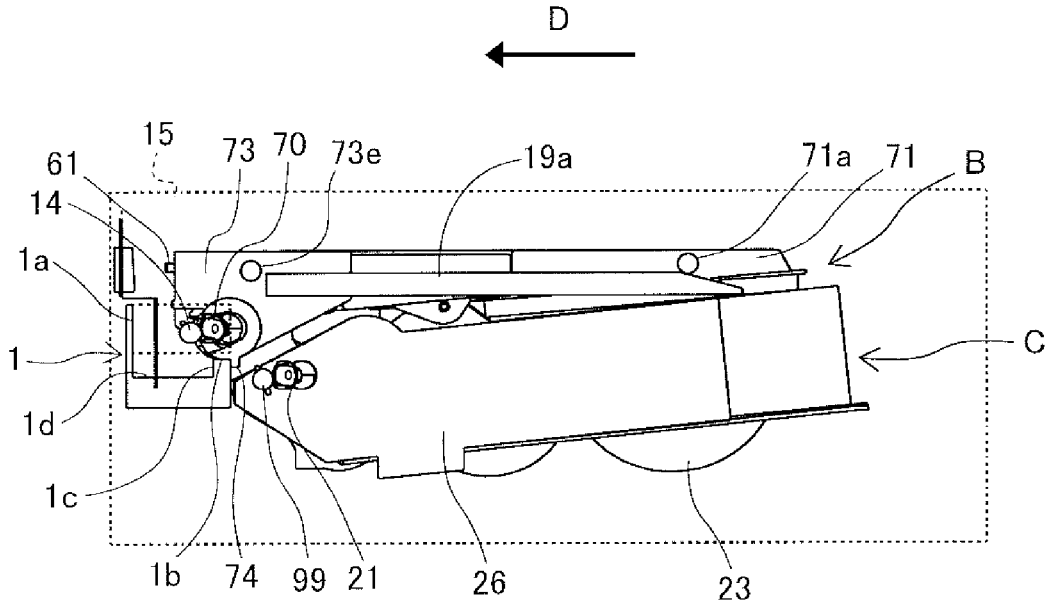
FIG. 22 is a view illustrating a positional relationship between the process unit and the members of the apparatus body according to the first embodiment.

Next, a configuration for positioning the photoconductor cartridge B with respect to the reference axis direction X will be described. As illustrated in FIGS. 15 and 22, the first drive shaft 14 of the apparatus body A is supported rotatably by the drive shaft support member 1 provided on the driven-side plate 15. The guide groove 1*c* described earlier is provided on the drive shaft support member 1 as a regulation portion for regulating the cartridge position in the reference axis direction X when attaching the photoconductor cartridge B to the apparatus body. The guide groove 1*c* according to the present embodiment is a trench-shaped groove that is dented downward on an upper surface of the second supporting portion 1*b* of the drive shaft support member 1 and extended in the insertion direction D of the cartridge. The aforementioned cutout portion 1*d* is provided on a downstream side in the insertion direction D of the guide groove 1*c*.

Further, a regulation member 2 having a regulation groove 2*a* is provided on the apparatus body A. The regulation groove 2*a* functions as a regulation portion that is provided on the apparatus body to regulate the cartridge position in the reference axis direction X in a state where the photoconductor cartridge B is attached to the apparatus body A. The regulation groove 2*a* is a trench-shaped groove that extends in a substantially vertical direction and opens upstream in the insertion direction D of the cartridge.

As illustrated in FIG. 21, a protruded portion 74 that fits to the guide groove 1*c* and a regulated portion 61 that fits to the regulation groove 2*a* are formed on the drum bearing 73 of the photoconductor cartridge B. The protruded portion 74 is protruded downward from the second supported portion 73*d* on which the drum bearing 73 is supported by the second supporting portion 1*b* of the drive shaft support member 1. Further, the regulated portion 61 is protruded downstream in the insertion direction D from an end face of the drum bearing 73 in the insertion direction D, that is, the face opposed to the regulation member 2 in the attached state.

Figure 24A:
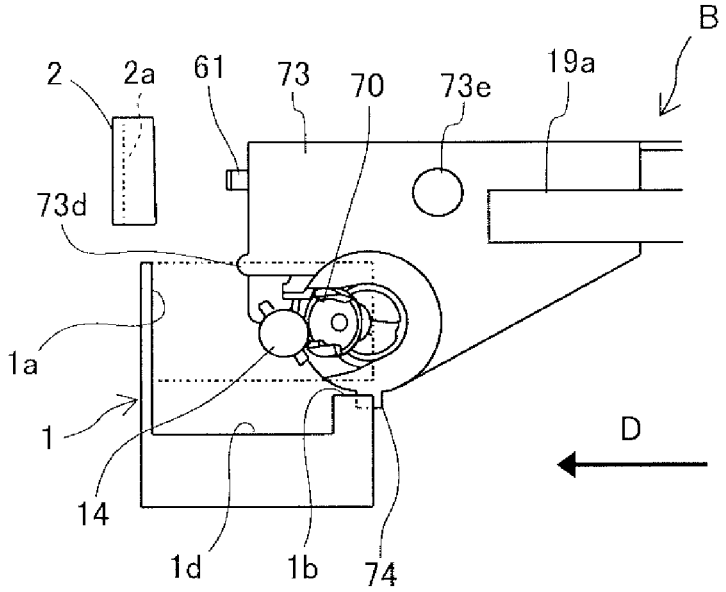
FIG. 24A is a side view illustrating a state of attachment operation of the photoconductor cartridge according to the first embodiment.
Figure 24B:
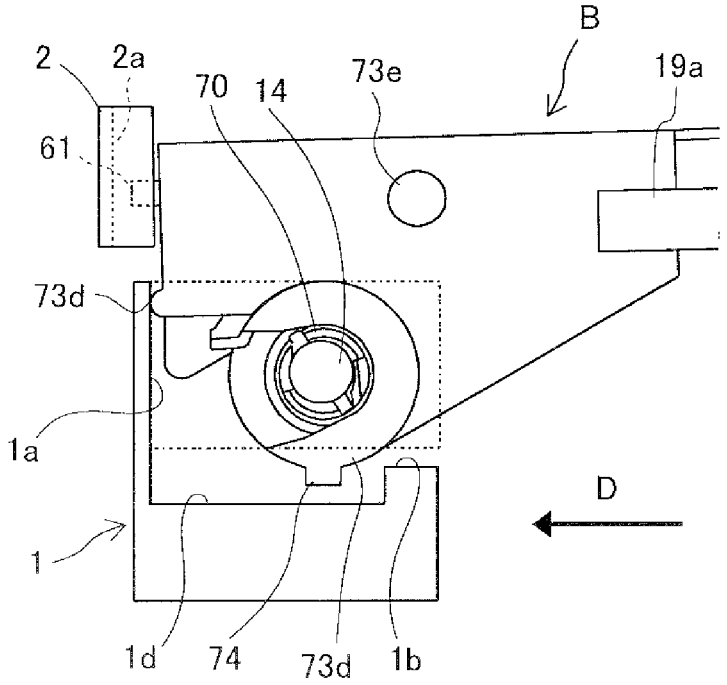
FIG. 24B is a side view illustrating the state of attachment operation of the photoconductor cartridge according to the first embodiment.
Figure 25A:
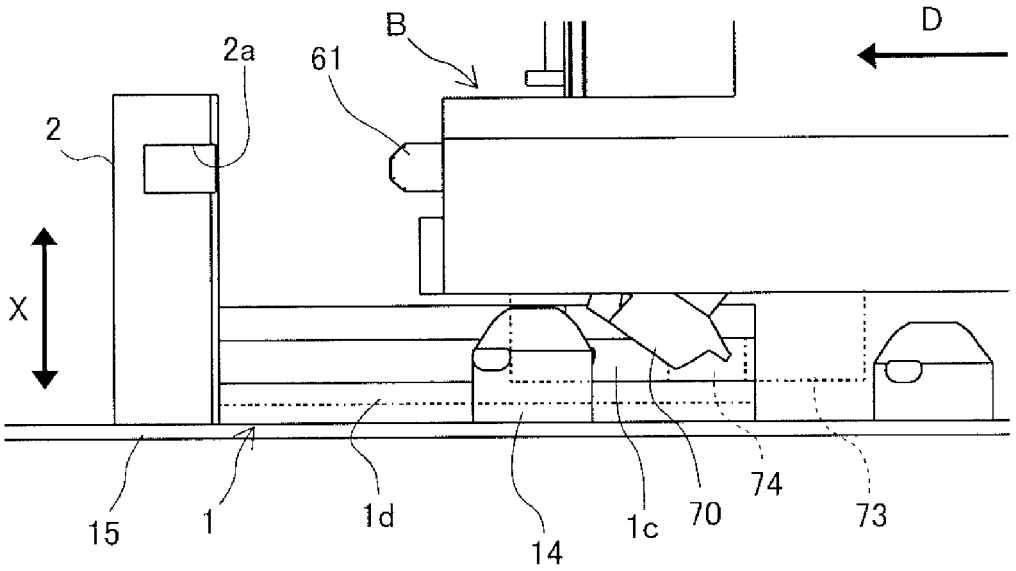
FIG. 25A is a top view illustrating the state of attachment operation of the photoconductor cartridge according to the first embodiment.
Figure 25B:
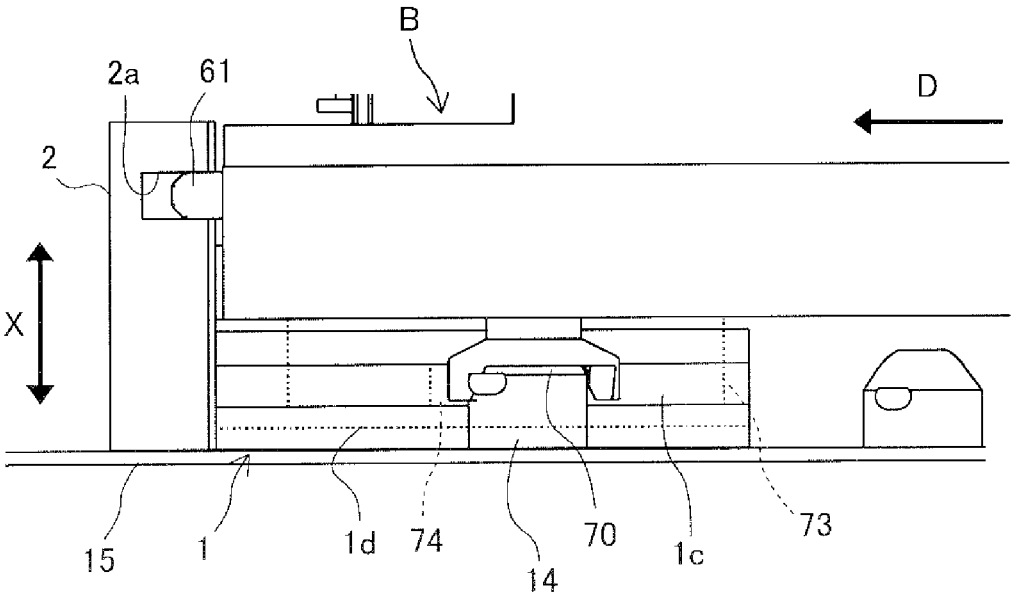
FIG. 25B is a top view illustrating the state of attachment operation of the photoconductor cartridge according to the first embodiment.

FIGS. 24 and 25 are views for describing the operation of the above-described positioning configuration when attaching the photoconductor cartridge B to the apparatus body A, wherein FIGS. 24A and 24B illustrate a state viewed in the reference axis direction X, and FIGS. 25A and 25B illustrate a state viewed from above. In a state where the photoconductor cartridge B is inserted to the insertion direction D, as illustrated in FIGS. 24A and 25A, the protruded portion 74 of the drum bearing 73 enters the guide groove 1*c* of the drive shaft support member 1. Thereby, the position of the photoconductor cartridge B in the reference axis direction X is regulated, so that the drum coupling 70 can be connected smoothly to the first drive shaft 14 along with the insertion of the photoconductor cartridge B.

When the photoconductor cartridge B moves further to the insertion direction D, as illustrated in FIGS. 24B and 25B, the protruded portion 74 of the drum bearing 73 reaches the cutout portion 1*d* of the drive shaft support member 1 and is withdrawn from the guide groove 1*c*. Therefore, the regulation of position of the photoconductor cartridge B by the fitting of the protruded portion 74 to the guide groove 1*c* is cancelled. While the photoconductor cartridge B moves to the attachment position, the regulated portion 61 provided on the drum bearing 73 fits to the regulation groove 2*a* provided on the apparatus body A. Thereby, in a state where the photoconductor cartridge B is attached to the apparatus body A, positioning of the photoconductor cartridge B in the reference axis direction X is performed by the fitting of the regulated portion 61 to the regulation groove 2*a*. The reference axis direction X is a main scanning direction of the photosensitive drum 62 in the image forming process, so that the image quality can be improved by positioning the photosensitive drum 62 with high accuracy by such positioning configuration.

A clearance between the guide groove 1*c* and the protruded portion 74 in the reference axis direction X is not necessarily matched with a clearance between the regulation groove 2*a* and the regulated portion 61 in the reference axis direction X. For example, the positioning accuracy of the photosensitive drum 62 during image forming operation may be improved by setting the former value smaller than the latter value. Further according to the present embodiment, the part used for positioning during attachment of cartridge, that is, the guide groove 1*c* and the protruded portion 74, is provided individually from a part used for positioning in the state where the cartridge is attached, that is, the regulation groove 2*a* and the regulated portion 61, but they can be arranged collectively. For example, it may be possible to extend the guide groove 1*c* to reach the area of the cutout portion 1*d* according to the present embodiment to enable the protruded portion 74 to be engaged to the guide groove 1*c* even in the state where the cartridge is attached.

Removal of Cartridge

The photoconductor cartridge B and the developing cartridge C can be removed from the apparatus body A by performing a removal operation of carrying out the steps of attachment operation described above in reverse order. In order to remove the developing cartridge C, the operator draws out the tray 18 to an opposite direction to the insertion direction D in a state where the door 13 of the apparatus body A is opened. Then, the first support hole 23*a* and the second support hole 23*b* are withdrawn from the coupling pins 69 and 69 and engagement between the developing cartridge C and the photoconductor cartridge B is cancelled. Further, the developing coupling 21 is withdrawn from the second drive shaft 99 of the apparatus body A. By lifting up the developing cartridge C from the tray 18 in a state where the tray 18 is drawn out to the predetermined position, removal of the developing cartridge C is completed. Thereafter, the operator may further remove the photoconductor cartridge B or set a new developing cartridge C to the tray 18 so that only the developing cartridge C is replaced.

In the present embodiment, service life of the photoconductor cartridge B is set longer than an average period of time for toner sealed in a new developing cartridge C to be consumed. Therefore, only the developing cartridge C can be replaced if there is no need to replace the photoconductor cartridge B.

When removing the photoconductor cartridge B, the operator draws out the photoconductor cartridge B to a direction opposite to the insertion direction D in a state where the developing cartridge C has been removed. Then, the photoconductor cartridge B is withdrawn from the drive shaft support member 1 and the non-drive side support member 12 on the apparatus body A, and the drum coupling 70 is withdrawn from the first drive shaft 14. Thereafter, the cartridge is drawn out further along the guide members 19*a* and 19*b*, by which the removal of the photoconductor cartridge B from the apparatus body A is completed.

Conveyance of Waste Toner

Figure 17A:
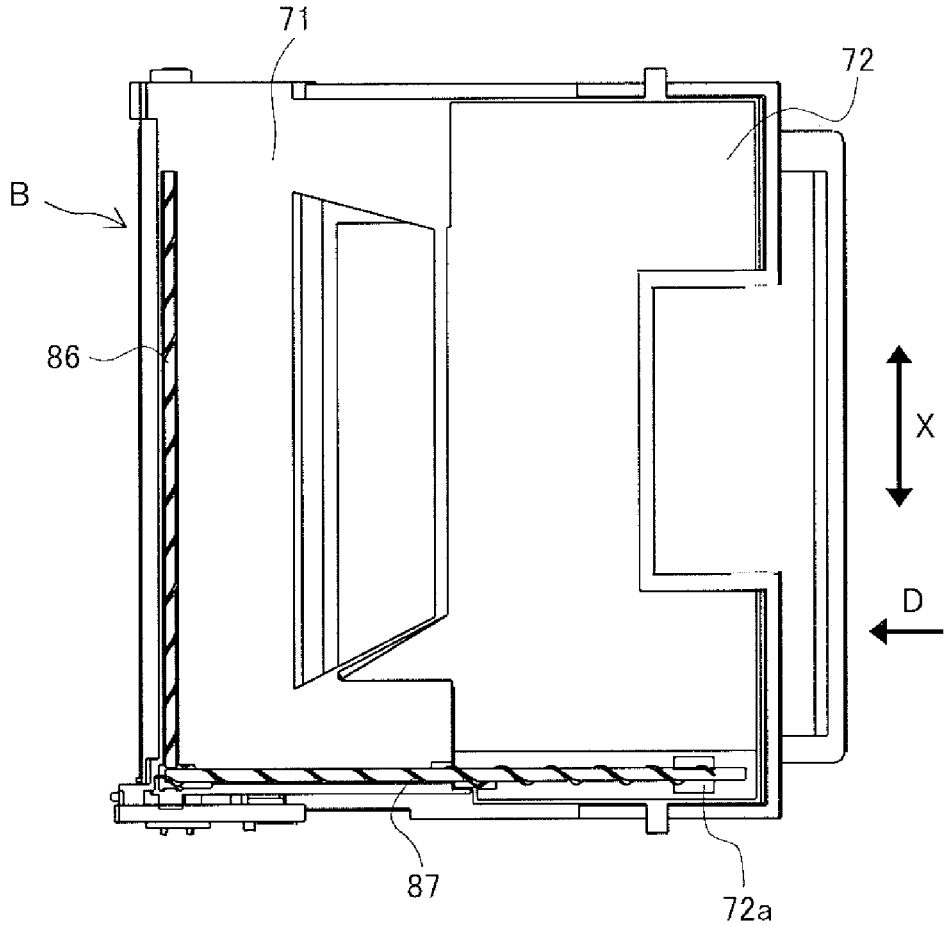
FIG. 17A is a cross-sectional view of the photoconductor cartridge according to the first embodiment.
Figure 17B:
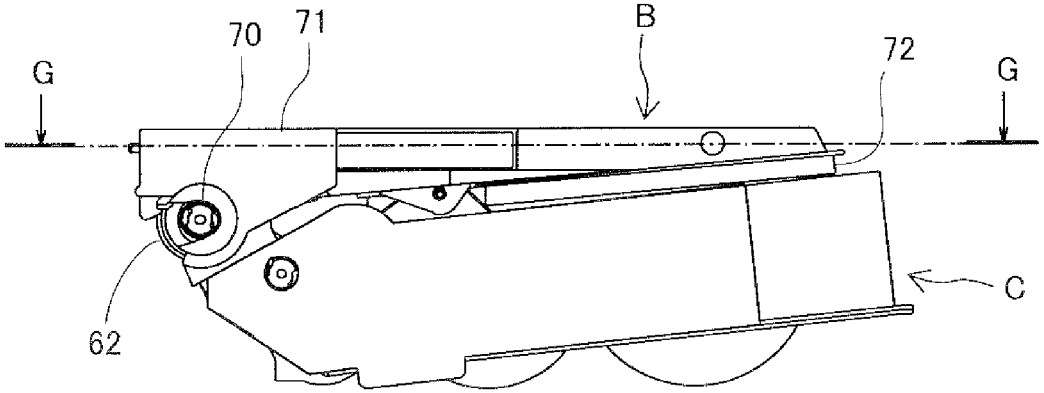
FIG. 17B is a side view of the photoconductor cartridge according to the first embodiment.

Next, a configuration for conveying waste toner collected by the cleaning member from the photosensitive drum will be explained. FIG. 17A is a cross-sectional view taken at cut line G-G of FIG. 17B to illustrate an inner structure of the photoconductor cartridge B. As illustrated in FIG. 17A, waste toner removed by the cleaning member 77 (refer to FIG. 2) from the surface of the photosensitive drum 62 is conveyed by a first screw 86 and a second screw 87 arranged on an inner side of the photoconductor cartridge B. The first screw 86 and the second screw 87 are conveyance members for conveying the waste from the photoconductor according to the present embodiment.

The first screw 86 is arranged near the photosensitive drum 62 and the cleaning member 77 so that a rotational axis thereof extends in the reference axis direction X (refer to FIG. 2), and it conveys waste toner to the drive side in the reference axis direction X. The second screw 87 is arranged inside the photoconductor cartridge B, and is laid in a direction intersecting the first screw 86 at an end portion on a downstream side in a conveyance direction of the first screw 86. The first screw 86 receives driving force from the above-described drum coupling 70 and rotates, and the second screw 87 receives driving force from the first screw 86 and rotates. As described in further detail in the third embodiment, the first screw 86 and/or the second screw 87 may receive driving force from the developing coupling 21 and rotate.

A waste toner discharge port 72*a* serving as a first opening portion capable of discharging waste toner to the developing cartridge C is provided on the lower surface of the lid member 72. The waste toner discharge port 72*a* is provided at a position opposing to a downstream portion of the second screw 87 in the conveyance direction of the second screw 87. Waste toner removed from the photosensitive drum 62 by the cleaning member 77 is first conveyed by the first screw 86 along the reference axis direction X, then conveyed by the second screw 87 to the waste toner discharge port 72*a* and discharged to an exterior of the photoconductor cartridge B.

Figure 26:
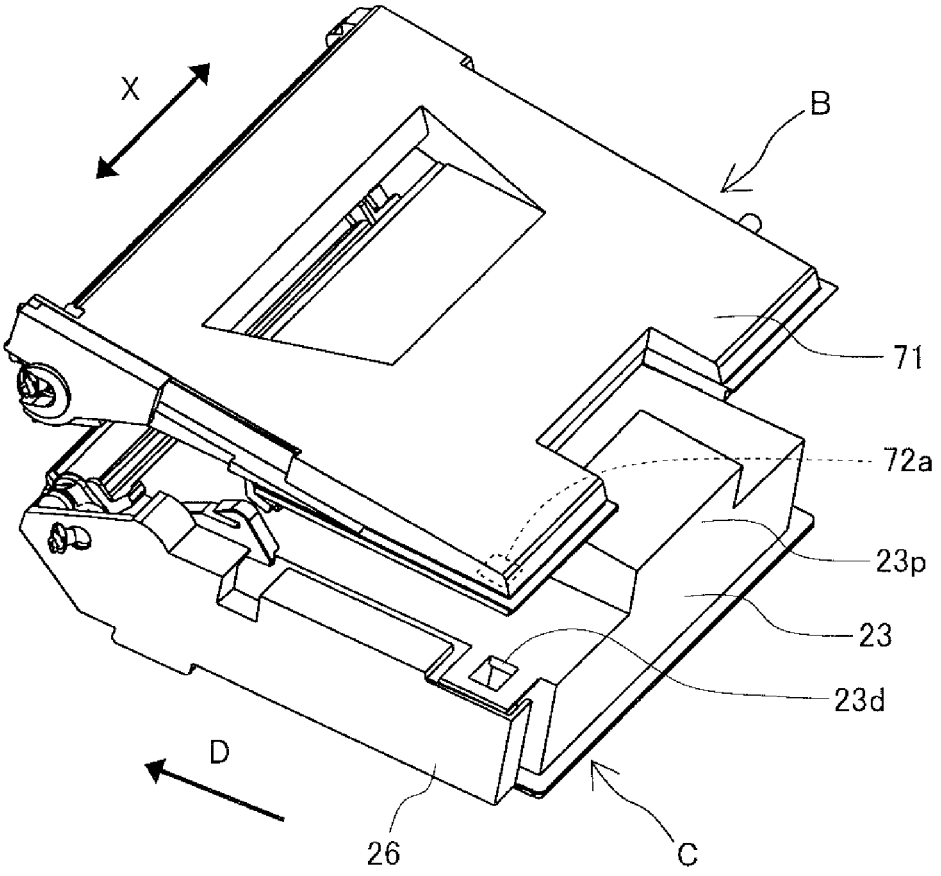
FIG. 26 is a view illustrating a mechanism for transferring waste toner between cartridges according to the first embodiment.
Figure 27A:
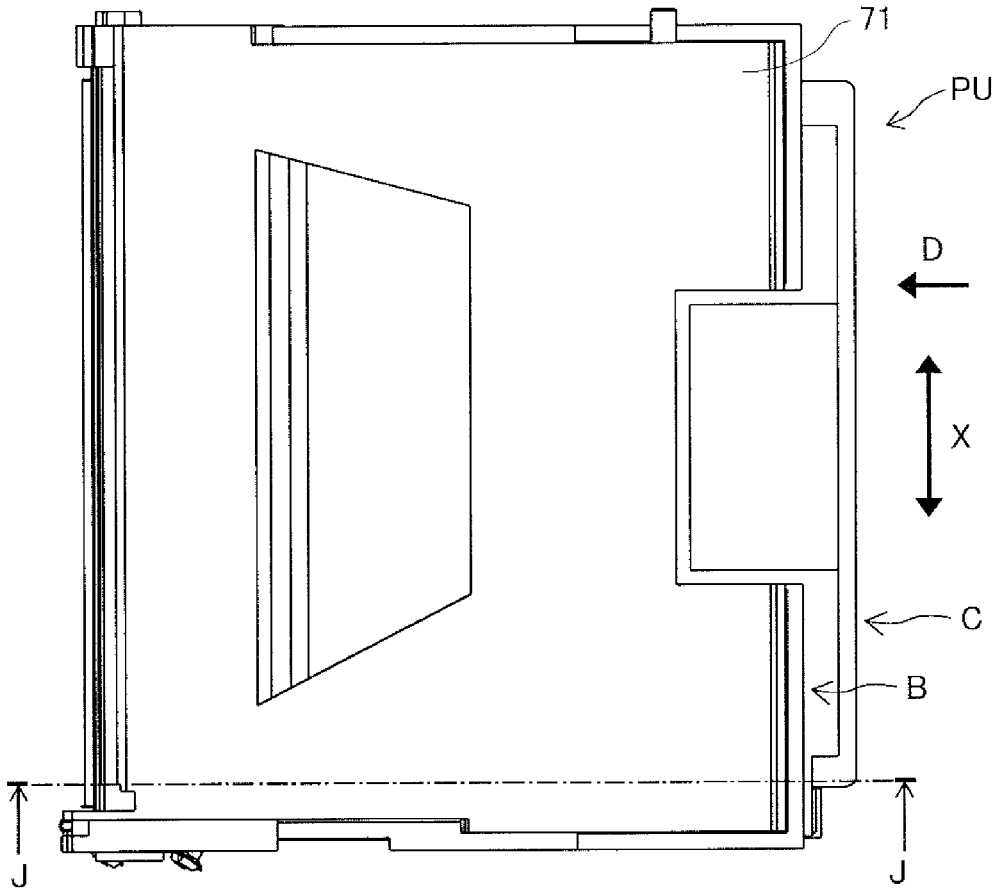
FIG. 27A is a cross-sectional view of the process unit according to the first embodiment.
Figure 27B:
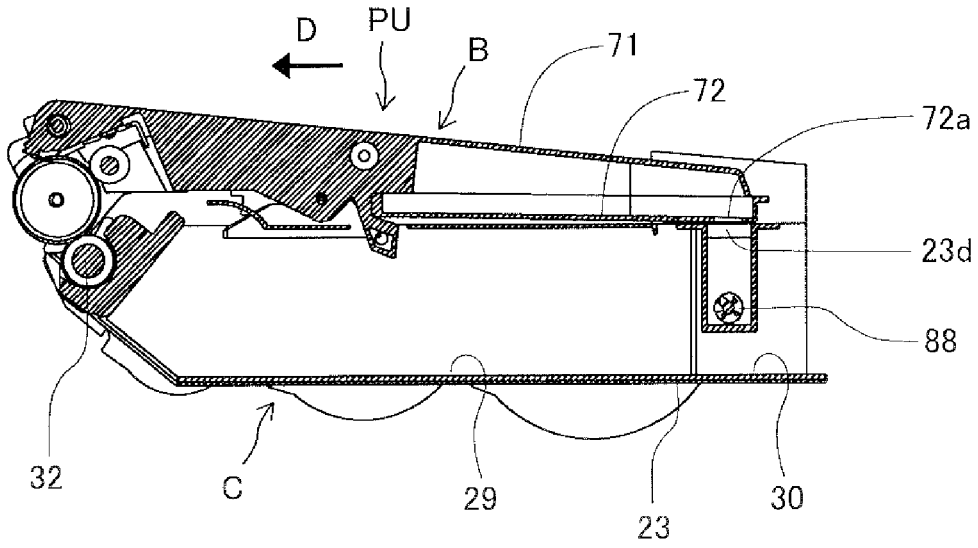
FIG. 27B is a side view of the process unit according to the first embodiment.

FIG. 26 is a perspective view illustrating a positional relationship between the photoconductor cartridge B and the developing cartridge C, and FIG. 27B is a cross-sectional view in which the process unit PU is cut at a cut line J-J of FIG. 27A. As illustrated in FIGS. 26 and 27B, the waste toner discharge port 72*a* is provided on the bottom surface of the photoconductor cartridge B. Further, a waste toner receiving port 23*d* serving as a second opening portion for receiving waste toner is provided on an upper surface of the developer container 23 at a position opposed to the waste toner discharge port 72*a*. Further, the waste toner chamber 30 serving as a storage portion for storing waste toner is provided in the developer container 23 at a position upstream of the toner chamber 29 with respect to the insertion direction D of the cartridge, that is, at an end portion distant from the developing roller 32. Waste toner discharged from the waste toner discharge port 72*a* passes through the waste toner receiving port 23*d* and flows into the waste toner chamber 30 of the developing cartridge C.

Figure 28A:
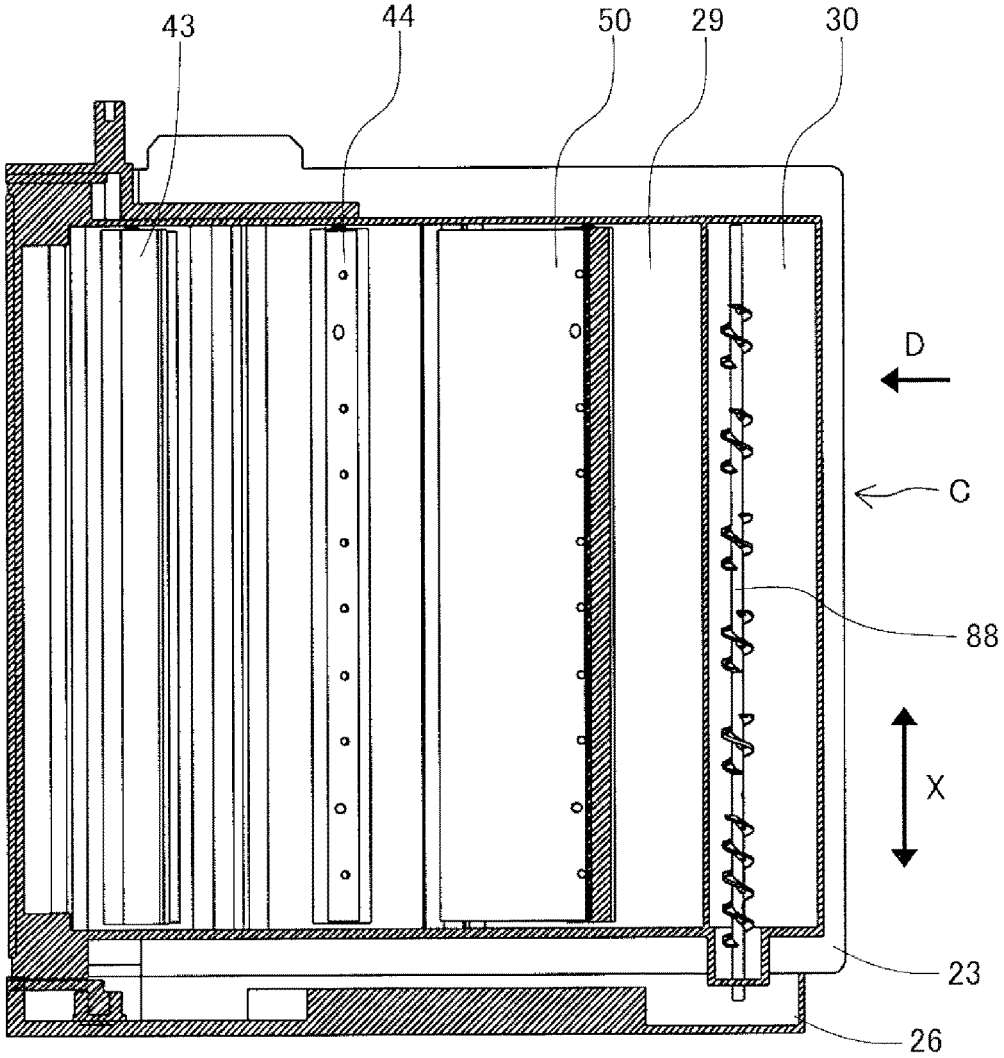
FIG. 28A is a cross-sectional view of the process unit according to the first embodiment.
Figure 28B:
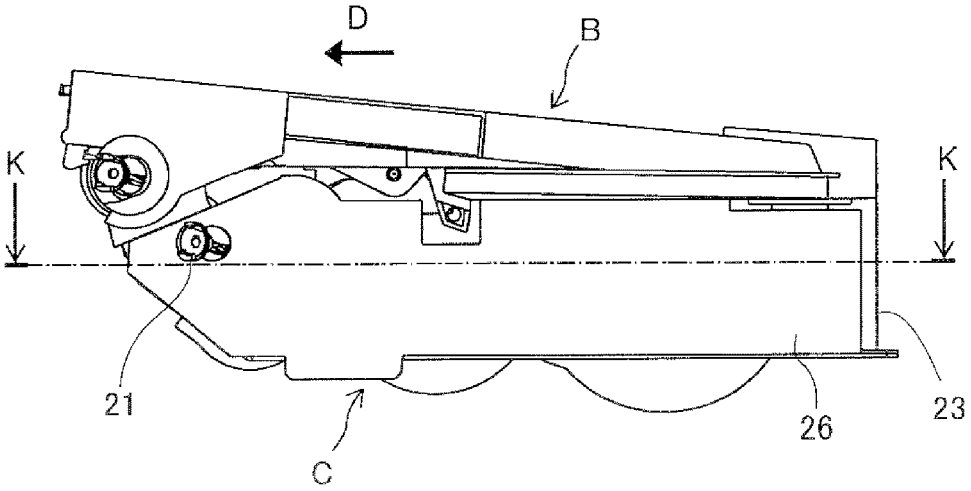
FIG. 28B is side view of the process unit according to the first embodiment.

FIG. 28A is a cross-sectional view of the developing cartridge C cut at a cut line K-K of FIG. 28B. As illustrated in FIGS. 27 and 28, a third screw 88 is provided on the waste toner chamber 30. The third screw 88 is arranged inside the waste toner chamber 30 that extends in the reference axis direction X so that an axial direction of the third screw 88 corresponds to the reference axis direction X, that is, so that it is arranged substantially in parallel with the first screw 86. Further, the third screw 88 is rotated by receiving driving force transmitted from the developing coupling 21 via a gear train not shown. According to the above-described configuration, waste toner flowing from the photoconductor cartridge B through the waste toner receiving port 23*d* to the waste toner chamber 30 of the developing cartridge C is conveyed as required in the reference axis direction X by the third screw 88 and filled in the waste toner chamber 30.

Further, shutters described later are provided respectively on the waste toner discharge port 72*a* of the photoconductor cartridge B and the waste toner receiving port 23*d* of the developing cartridge C. In a state where the photoconductor cartridge B and the developing cartridge C are attached to the apparatus body A, the shutters are in an opened state, so that the waste toner discharge port 72*a* and the waste toner receiving port 23*d* are communicated. In a state where the photoconductor cartridge B and the developing cartridge C are separated, such as when the developing cartridge C is removed from the apparatus body A, both shutters are closed to prevent waste toner from leaking to the exterior.

The following is an actual configuration example of such a shutter mechanism. A shutter member capable of sliding in the insertion direction D is arranged on a casing of each cartridge, and an urging member that urges each shutter toward a direction closing the opening portion is provided. Then, during the insertion operation of the developing cartridge C, a portion of the developing cartridge C slides the shutter of the photoconductor cartridge B in the insertion direction D to open the waste toner discharge port 72*a*. Further, in parallel therewith, a portion of the photoconductor cartridge B slides the shutter of the developing cartridge C in an opposite direction as the insertion direction D to open the waste toner receiving port 23*d*. Hereafter, the configuration will be illustrated in detail with reference to FIGS. 29A and 29B.

Figure 29A:
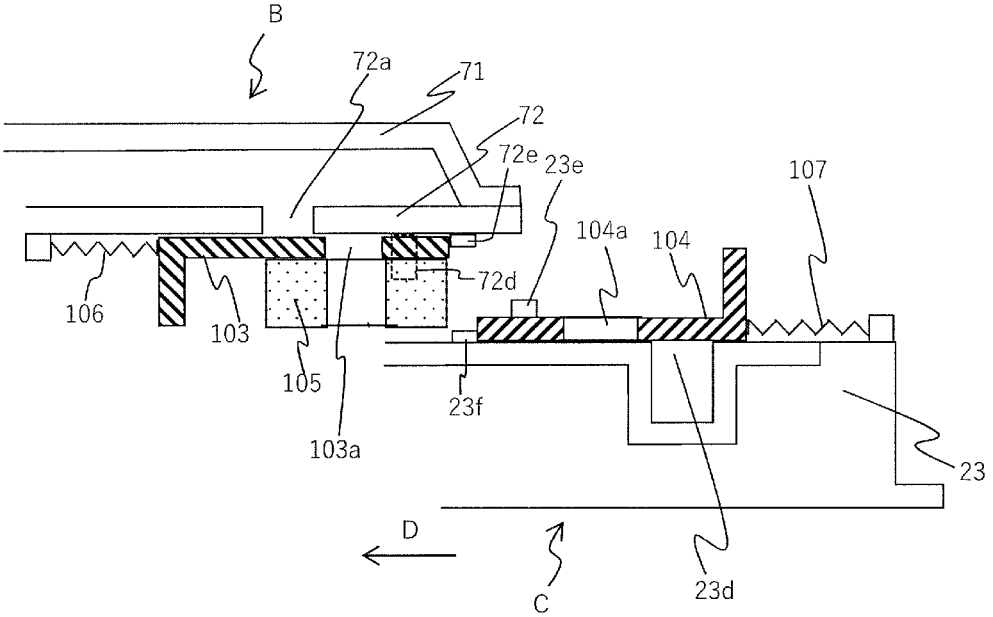
FIG. 29A is a view illustrating a configuration of a communicating portion of waste toner between cartridges according to the first embodiment.
Figure 29B:
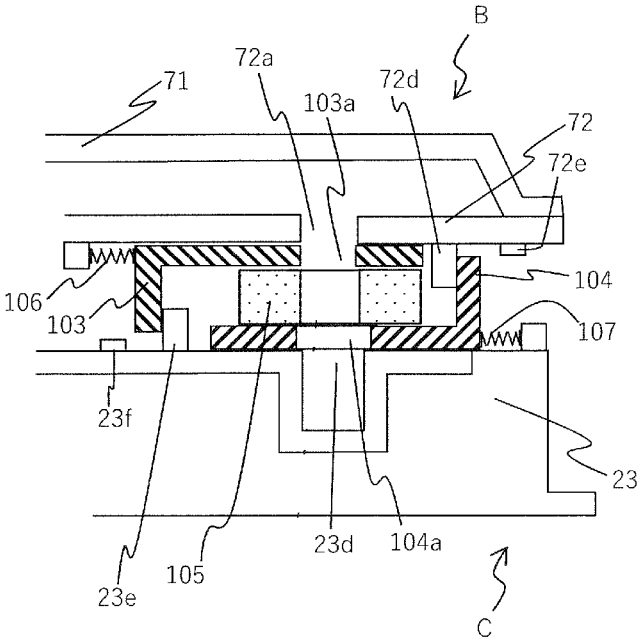
FIG. 29B is a view illustrating a configuration of the communicating portion of waste toner between cartridges according to the first embodiment.

As illustrated in FIGS. 29A and 29B, a shutter 103 for opening and closing the waste toner discharge port 72*a* is provided on the photoconductor cartridge B. A shutter 104 for opening and closing the waste toner receiving port 23*d* is provided on the developing cartridge C. Opening portions 103*a* and 104*a* are respectively provided on the shutters 103 and 104. The state in which the opening portions 103*a* and 104*a* correspond, that is, oppose, to the waste toner discharge port 72*a* and the waste toner receiving port 23*d* in a horizontal direction perpendicular to a gravity direction (FIG. 29B) is a state where the shutters 103 and 104 are opened. A sealing member 105 is provided on the shutter 103. The sealing member 105 prevents waste toner from leaking in a state where the photoconductor cartridge B and the developing cartridge C are engaged. The sealing member 105 according to the present embodiment is an elastic member formed of an elastic material such as urethane foam, and it is adhered to the shutter 103 by a double-sided tape or an adhesive and the like. FIG. 29A illustrates a state where the shutters 103 and 104 are closed in a state where the developing cartridge C and the photoconductor cartridge B are separated. Further, FIG. 29B illustrates a state where the shutters 103 and 104 are opened in a state where the developing cartridge C and the photoconductor cartridge B are engaged.

The configuration of the shutters 103 and 104 will be described in detail hereafter. The shutter 103 is attached to the lid member 72 slidably in a direction parallel to the insertion direction D of the cartridge. The shutter 103 is urged by an urging member 106, such as a compression spring, in a direction opposite to the cartridge insertion direction D, that is, right direction in FIGS. 29A and 29B. Thereby, the position of the shutter 103 is determined by abutting against an abutment portion 72*e* in a state where the developing cartridge C and the photoconductor cartridge B are separated (FIG. 29A). This is the state where the shutter 103 is closed. Similarly, the shutter 104 is mounted to the developer container 23 slidably in the direction parallel to the cartridge insertion direction D. The shutter 104 is urged in the cartridge insertion direction D by an urging member 107, such as a compression spring. Thereby, the position of the shutter 104 is determined by abutting against an abutment portion 23*f* in a state where the developing cartridge C and the photoconductor cartridge B are separated (FIG. 29A). This is the state where the shutter 104 is closed.

When the developing cartridge C is inserted to the apparatus body A, the shutter 103 slides by being pressed by a projection 23*e* on the developer container 23 in the cartridge insertion direction D, i.e., left direction in FIGS. 29A and 29B, and will be in an opened state, i.e., in a state where the opening portion 103*a* is opposed to the waste toner discharge port 72*a*. Similarly, the shutter 104 slides by being pressed by a projection 72*d* on the lid member 72 in a direction opposite to the cartridge insertion direction D, i.e., right direction in FIG. 29, and will be in an opened state, i.e., in a state where the opening portion 104*a* is opposed to the waste toner receiving port 23*d*. In this state, the sealing member 105 is compressed between the shutters 103 and 104 in a direction orthogonal to the cartridge insertion direction D, that is, up-down direction in FIGS. 29A and 29B, and waste toner is prevented from leaking between the photoconductor cartridge B and the developing cartridge C.

In the above description, a configuration where a shutter is provided on both the photoconductor cartridge B and the developing cartridge C has been illustrated, but for example, the waste toner receiving port 23*d* of the developing cartridge C that faces upward may be opened without having a shutter provided thereto.

Figure 30:
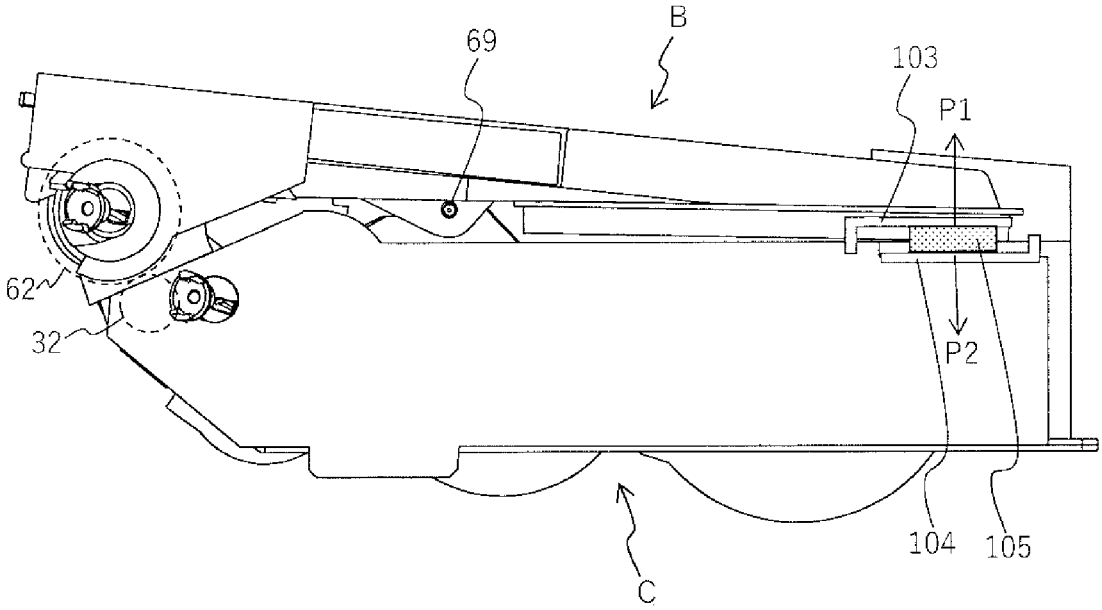
FIG. 30 is a side view of the image forming unit according to the first embodiment.

Next, another operation of the sealing member 105 will be described with reference to FIG. 30. FIG. 30 is a side view illustrating a state where the photoconductor cartridge B and the developing cartridge C are engaged. As have been already described, the developing cartridge C is swingable in a direction in which the developing roller 32 moves toward and away from the photosensitive drum 62 around the coupling pin 69 serving as fulcrum. The photosensitive drum 62 and the developing roller 32 are opposed to each other in a direction intersecting the cartridge insertion direction D, that is, approximately in the up-down direction of FIG. 30. The waste toner discharge port 72*a* and the waste toner receiving port 23*d* are opposed to each other in the direction intersecting the cartridge insertion direction D (FIG. 26).

Now, the waste toner discharge port 72*a* and the waste toner receiving port 23*d* are arranged on an opposite side as the opposing portion of the photosensitive drum 62 and the developing roller 32 with respect to the coupling pin 69 in the cartridge insertion direction D. The sealing member 105 is compressed in a manner sandwiched by the shutter 103 and the shutter 104 between the waste toner discharge port 72*a* and the waste toner receiving port 23*d*. Therefore, a moment in a direction approximating the photosensitive drum 62 and the developing roller 32 acts on the photoconductor cartridge B and the developing cartridge C by repulsive force P1 and P2 of the sealing member 105. According to such configuration, the positioning of the developing roller 32 with respect to the photosensitive drum 62 can be realized reliably. Further, the use of repulsive force of the sealing member 105 can minimize urging force of the urging member 100 or eliminate the urging member 100 for pushing up the developing cartridge C. According further to the present configuration utilizing repulsive force of the sealing member 105 provided between the photoconductor cartridge B supporting the photosensitive drum 62 and the developing cartridge C supporting the developing roller 32, the urging force of the developing roller 32 with respect to the photosensitive drum 62 can be set highly accurately.

As described, the photoconductor cartridge B and the developing cartridge C respectively constitute a processing cartridge that can be respectively detachably attached to the apparatus body of the image forming apparatus. The photoconductor cartridge B corresponds to a first unit that includes a rotatable image bearing member, i.e., the photosensitive drum 62, and the developing cartridge C corresponds to a second unit including a developer bearing member, i.e., the developing roller 32, for developing the latent image borne on the image bearing member. The developing cartridge C is supported swingably on the photoconductor cartridge B, and includes the discharge port (72*a*) through which waste removed from the image bearing member is discharged and the receiving port (23*d*) through which waste discharged through the discharge port (72*a*) is received. Further, in a state where the photoconductor cartridge B and the developing cartridge C are positioned with respect to the apparatus body A, the discharge port (72*a*) and the receiving port (23*d*) are opposed in substantially the same direction as the direction in which the image bearing member and the developer bearing member are opposed. In this state, a center of swinging motion of the developing cartridge C and the photoconductor cartridge B is interposed between (i) the opposing portion where the discharge port (72*a*) and the receiving port (23*d*) oppose to one another and (ii) the opposing portion of the image bearing member and the developer bearing member. In other words, (i) the opposing portion in which the discharge port (72*a*) and the receiving port (23*d*) are opposed is arranged on an opposite side as (ii) the opposing portion of the image bearing member and the developer bearing member, with respect to the center of swinging motion of the developing cartridge C and the photoconductor cartridge B. Further, an elastic sealing member (105) is provided between the discharge port (72*a*) and the receiving port (23*d*).

Second Embodiment

Next, an image forming apparatus according to a second embodiment will be described. The present embodiment differs from the first embodiment in that a photoconductor cartridge is inserted to the apparatus body in a state supported by a drawer member other than the tray 18 described above. Components having a similar configuration and effect as those of the first embodiment are denoted with the same reference numbers as the first embodiment, and descriptions thereof are omitted.

Figure 31:
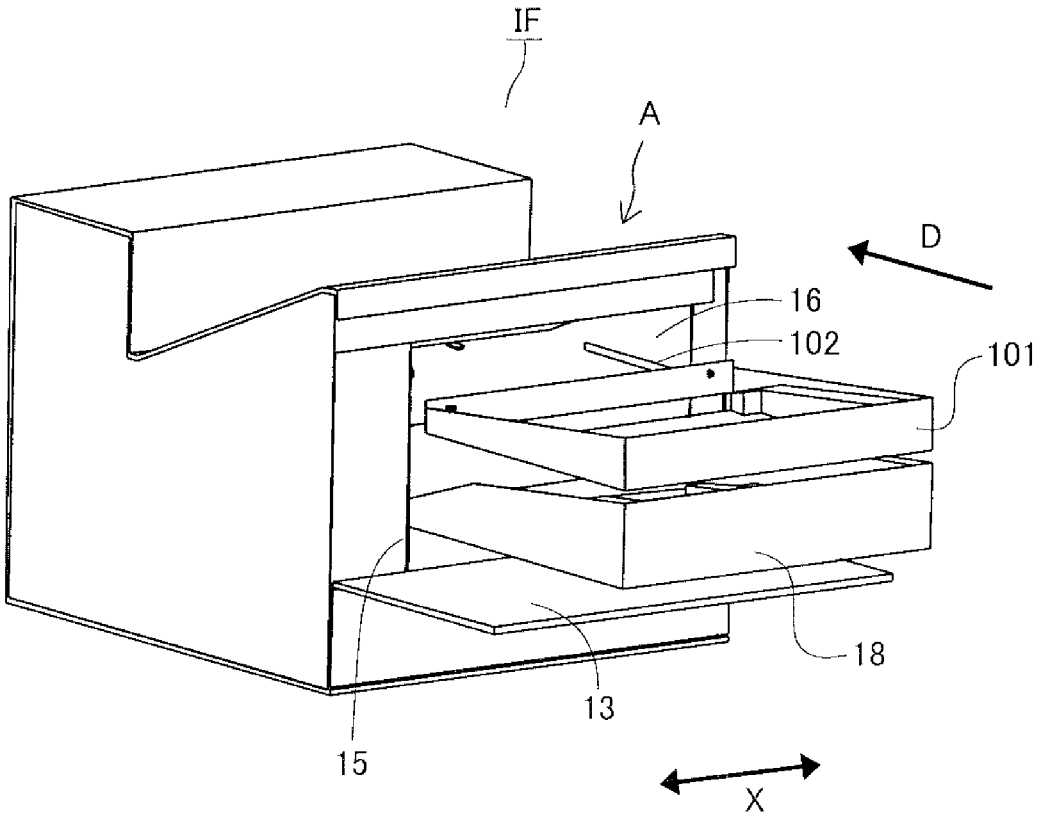
FIG. 31 is perspective view of an apparatus body and a tray of an image forming apparatus according to a second embodiment.

As illustrated in FIG. 31, an upper tray 101 that supports a photoconductor cartridge B is provided above a tray 18, i.e., lower tray, supporting the developing cartridge C in an image forming apparatus IF according to the present embodiment. The upper tray 101 is another example of a guide unit that guides attachment and detachment of the photoconductor cartridge B with respect to the apparatus body A. The upper tray 101 is supported by a guide rail 102 provided on the apparatus body A and inserted to and drawn out of the apparatus body A along the insertion direction D of the cartridge. That is, the tray 18 is a drawer member in the present embodiment and the upper tray 101 is another drawer member in the present embodiment.

Figure 32A:
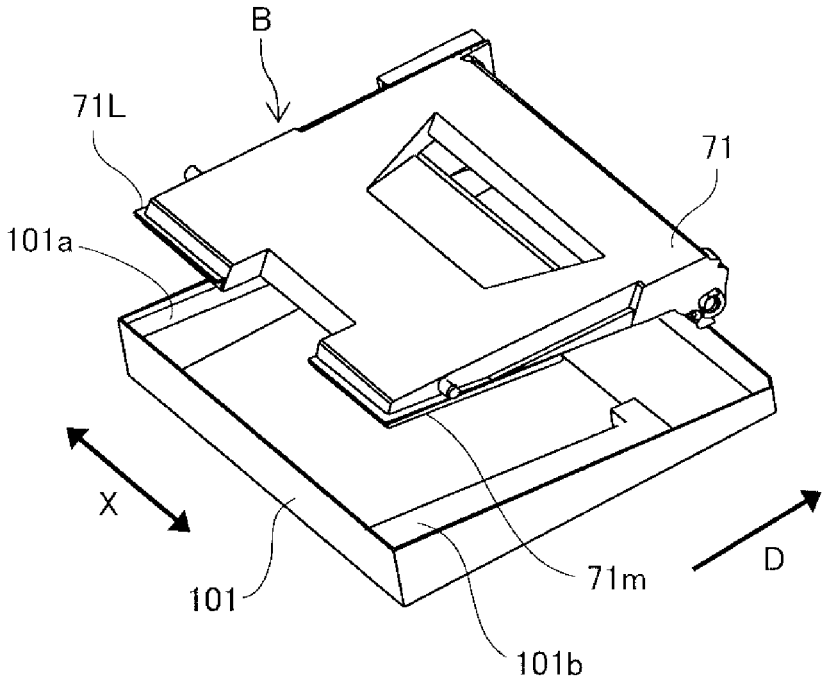
FIG. 32A is a perspective view of a photoconductor cartridge and an upper tray according to the second embodiment.
Figure 32B:
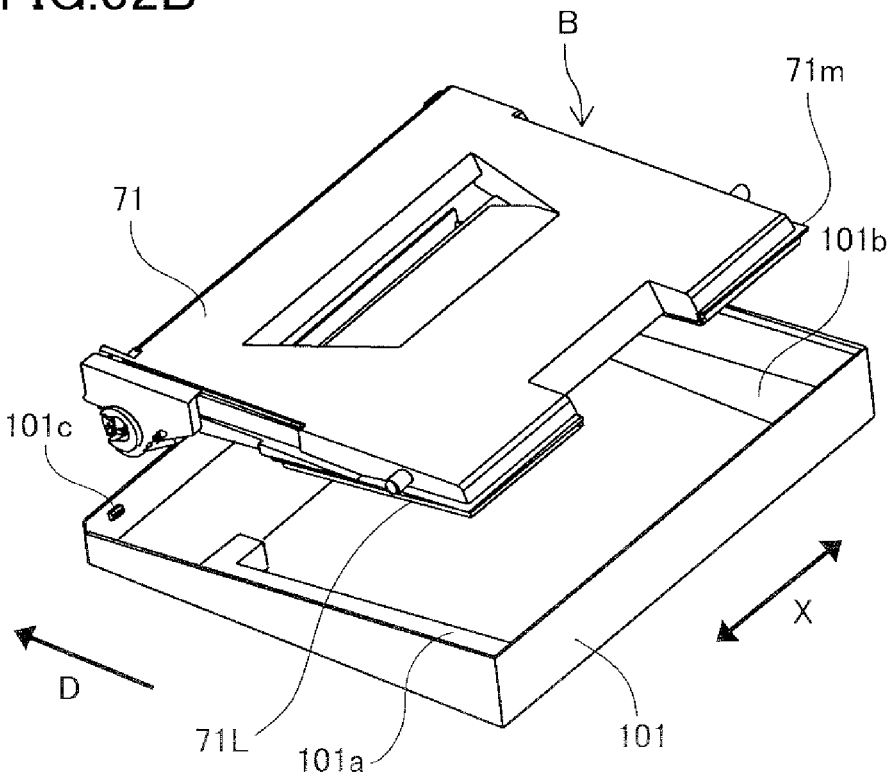
FIG. 32B is a perspective view of the photoconductor cartridge and the upper tray according to the second embodiment.

As illustrated in FIGS. 32A and 32B, the photoconductor cartridge B includes a supported surface 71L on a drive side and a supported surface 71*m* on a non-drive side in the reference axis direction X, and the upper tray 101 includes supporting surfaces 101*a* and 101*b* that respectively support the supported surfaces 71L and 71*m*. Further, the upper tray 101 includes a regulation portion 101*c* that regulates movement of the photoconductor cartridge B with respect to the insertion direction D at a wall surface of the cartridge at a downstream side in the insertion direction D.

Figure 33:
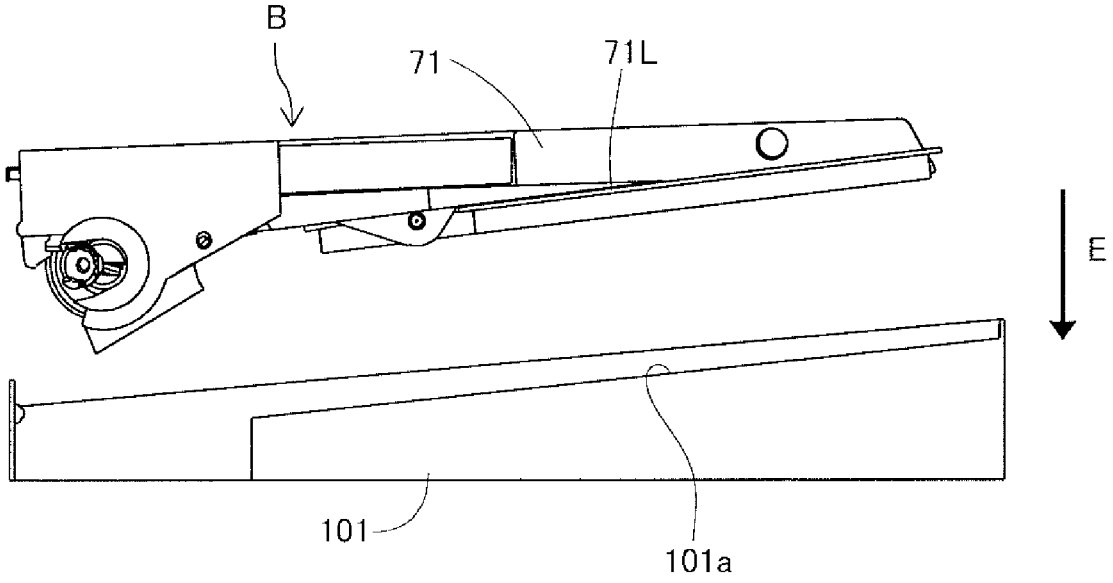
FIG. 33 is a view illustrating a state of operation in which the photoconductor cartridge is loaded on the upper tray according to the second embodiment.
Figure 34:
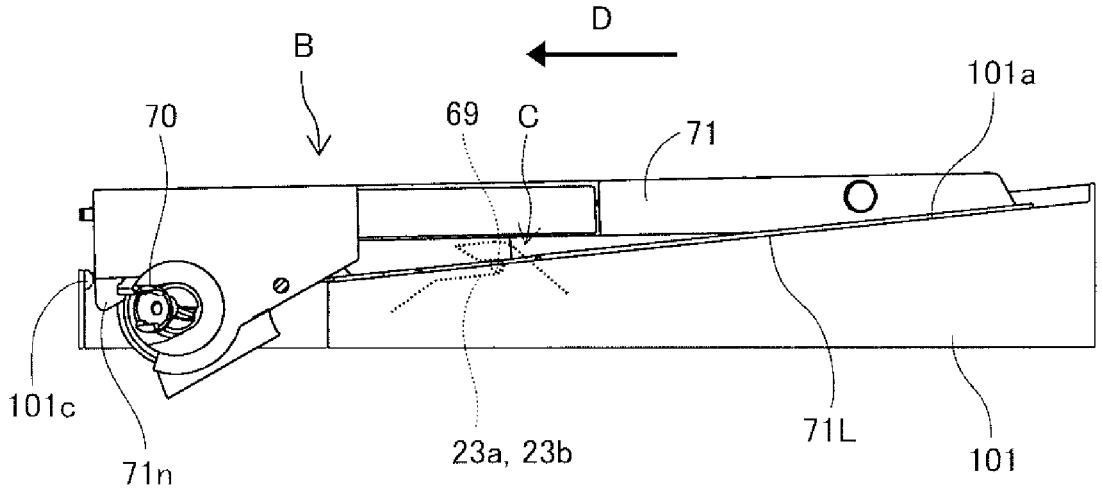
FIG. 34 is a view illustrating a state of operation in which the photoconductor cartridge is loaded on the upper tray according to the second embodiment.

FIGS. 33 and 34 illustrate a state in which the operation for supporting the photoconductor cartridge B on the upper tray 101 is viewed from a drive side in the reference axis direction X. The operation on the drive side will be described in the following description, but a similar operation is performed on the non-drive side.

As illustrated in FIG. 33, the photoconductor cartridge B is set from above to the tray 101 drawn out to a predetermined position where attaching and detaching of the photoconductor cartridge B to and from the apparatus body A is enabled. The operator places the cartridge from above the upper tray 101 downward while holding the holding part of the photoconductor cartridge B (arrow E). Then, as illustrated in FIG. 34, the supported surface 71L of the photoconductor cartridge B contacts a supporting surface 101*a* of the upper tray 101 and is supported thereby. Further, a regulated portion 71*n* provided on an end face on a downstream side in the insertion direction D of the photoconductor cartridge B contacts the regulation portion 101*c* of the upper tray 101, by which the photoconductor cartridge B is supported by the upper tray 101.

The operation of attaching the photoconductor cartridge B and the developing cartridge C to the apparatus body A that follows is the same as the first embodiment. That is, by inserting the upper tray 101 supporting the photoconductor cartridge B to the apparatus body A toward the insertion direction D, the drum coupling 70 is connected to the first drive shaft 14 of the apparatus body A (FIGS. 23A and 23B). Further, the protruded portion 74 of the photoconductor cartridge B fits to the guide groove 1*c* of the drive shaft support member 1, and thereafter, the regulated portion 61 fits to the regulation groove 2*a* of the regulation member 2, by which the positioning in the reference axis direction X during and after attachment is realized (FIGS. 24 and 25).

Further, if the developing cartridge C is inserted to the apparatus body A in a state where the photoconductor cartridge B is attached to the apparatus body A, the first support hole 23*a* and the second support hole 23*b* of the developing cartridge C fit to the coupling pins 69 and 69 of the photoconductor cartridge B (FIG. 34). Thereby, the developing cartridge C is supported on the photoconductor cartridge B. An opening portion is formed on the bottom side of the upper tray 101 to realize fitting of the coupling pins 69 and 69 to the first support hole 23*a* and the second support hole 23*b*. When the developing cartridge C is inserted to the attachment position, the developing coupling 21 is connected to the second drive shaft 99, by which the waste toner discharge port 72*a* of the photoconductor cartridge B and the waste toner receiving port 23*d* of the developing cartridge C are communicated.

According to the present embodiment, the attachment and detachment of the photoconductor cartridge B and the developing cartridge C are performed in a state where the cartridges are supported by trays (18 and 101). By inserting the tray 18 supporting the developing cartridge C in a direction intersecting the reference axis direction X, that is, in the insertion direction D, the developing cartridge C is engaged with the photoconductor cartridge B attached to the apparatus body A. That is, even according to the configuration of the present embodiment, the replacement operation of the cartridges is facilitated in a configuration where the image forming unit is composed of a plurality of cartridges, and an image forming unit and an image forming apparatus having a high usability can be provided.

Third Embodiment

Figure 35:
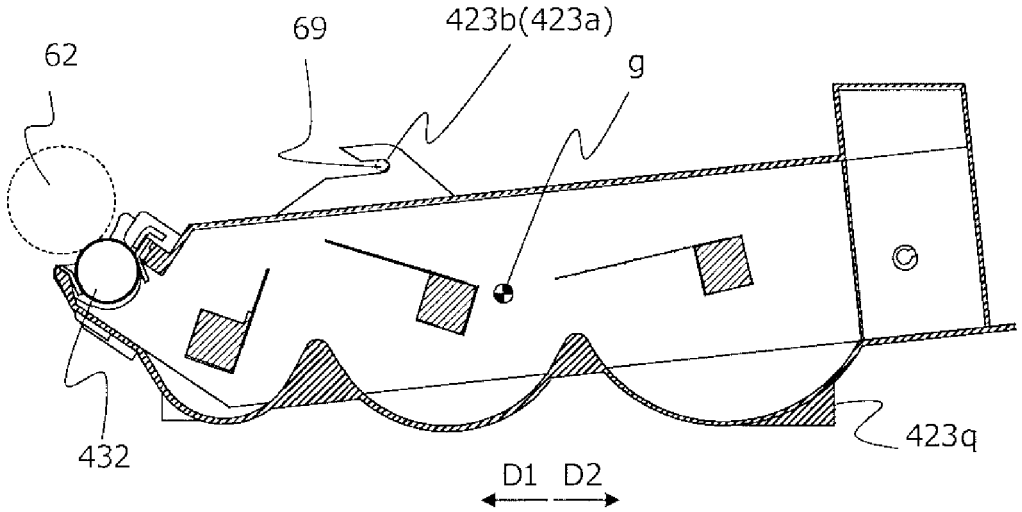
FIG. 35 is an explanatory cross-sectional view of a developing cartridge according to a third embodiment.
Figure 36A:
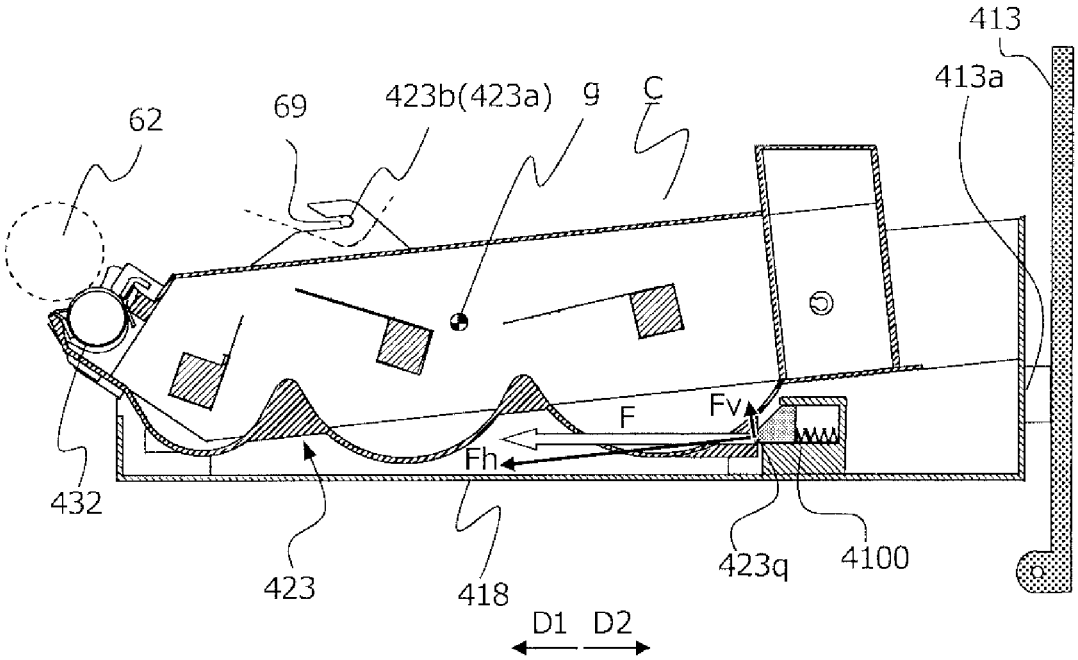
FIG. 36A is a cross-sectional view illustrating a configuration of the developing cartridge and a tray in an apparatus body according to the third embodiment.
Figure 36B:
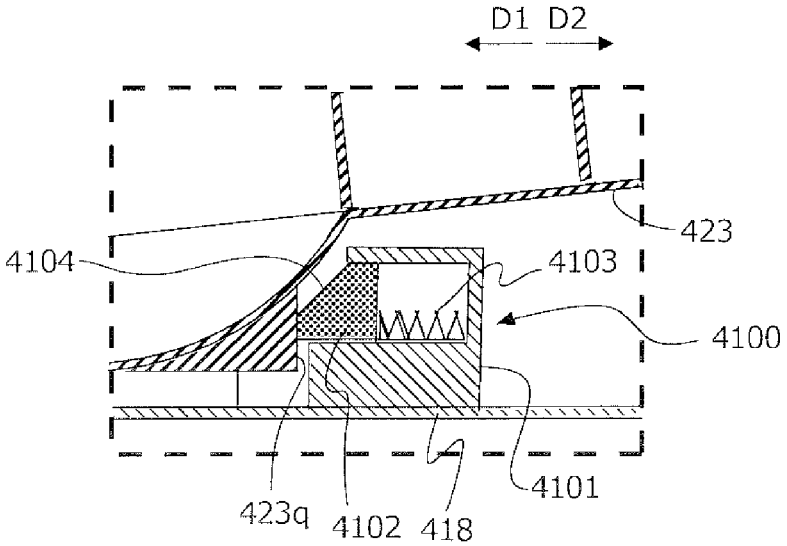
FIG. 36B is an enlarged cross-sectional view illustrating an urged surface and an urging unit in enlarged view according to the third embodiment.

A third embodiment will be described with reference to FIGS. 35 to 36B. FIG. 35 is a cross-sectional view illustrating a configuration of the developing cartridge C according to the present embodiment. FIG. 36A is a cross-sectional view illustrating a developing cartridge C according to the present embodiment and a configuration of a tray 418 within the apparatus body A, and FIG. 36B is an enlarged view in which a portion thereof is enlarged. Components having the same or equivalent configurations and effect as the first embodiment are denoted with the same reference numbers, and detailed descriptions thereof are omitted.

As illustrated in FIG. 35, a center of gravity g of the developing cartridge C is arranged at a position farther than a first support hole 423*a*, and a second support hole 423*b*, when viewed from a developing roller 432. Thereby, the developing roller 432 of the developing cartridge C can be abutted stably against the photosensitive drum 62.

As described earlier, in the first embodiment, the developing cartridge C placed on a tray 18 is attached to such a position where a rear end of the first support hole 23*a* (and the second support hole 23*b*) in the insertion direction is engaged with the coupling pin 69 (refer to FIG. 13). Then, the developing roller 32 is abutted against the photosensitive drum 62 and positioned by the urging member 100 serving as a spring member provided at a bottom portion of the tray 18 (refer to FIG. 14).

In a state where the developing cartridge C whose center of gravity is set as according to the present embodiment is placed on the tray 18 of the first embodiment and attached to the attachment complete position, force that is applied in a direction withdrawing from the coupling pin 69 is applied to the first support hole 423*a* (and the second support hole 423*b*) by the weight of the developing cartridge C. As a result, the developing cartridge C may swing around the coupling pin 69 serving as fulcrum frontward than a rear end in the insertion direction of the first support hole 423*a* (and the second support hole 423*b*) in the attachment direction, that is, the insertion direction D1. Further, it is difficult to control how each of the first support hole 423*a* and the second support hole 423*b* will swing with an area frontward than the rear end in the insertion direction serving as fulcrum. As a result, there is fear that the developing roller 432 may not be stably abutted and pressed against an area frontward than the photosensitive drum 62.

Therefore, according to the present embodiment, as illustrated in FIG. 36A, an urged surface 423*q* is provided to an urging portion 4100 so that the urging portion 4100 of the tray 418 is urged toward a groove direction (longitudinal direction) of the first support hole 423*a* (and the second support hole 423*b*) of the developing cartridge C. The urged surface 423*q* is a portion of an outer circumference of a developer container 423 that constitutes the casing of the developing cartridge C. By providing the urged surface 423*q* and the urging portion 4100, the developing roller 432 is urged in the direction approaching the photosensitive drum 62, and the developing roller 32 can be positioned more reliably with respect to the photosensitive drum 62.

As illustrated in FIG. 36A, the urged surface 423*q* is approximately perpendicular to the groove direction of the first support hole 423*a* (and the second support hole 423*b*). More specifically, in a state where an urging force F of the urging portion 4100 is received by the urged surface 423*q*, the force is decomposed into a force Fh that is a component of a direction parallel to the groove direction of the first support hole 423*a* (and the second support hole 423*b*) and a force Fv that is a component of a direction perpendicular to the first support hole 423*a* (and the second support hole 423*b*). In this state, the urged surface 423*q* is set so that the force Fh of the component in the parallel direction is greater than the force Fv of the component in the perpendicular direction. The urging portion 4100 for abutting the developing roller 432 against the photosensitive drum 62 is provided on a tray 518, and the urged surface 423*q* functions as an urged surface being urged by the urging portion 4100.

As illustrated in FIG. 36B, the urging portion 4100 of the present embodiment is composed of a supporting portion 4101 fixed to the tray 418, a pressing member 4102 supported by the supporting portion 4101, and a spring 4103 serving as an urging member for urging the pressing member 4102. The pressing member 4102 can slide in the insertion direction D1 and the draw-out direction D2, and it is arranged to abut against the urged surface 423*q* of the developing cartridge C set from above to the tray 418. Then, by being urged by the spring 4103, the pressing member 4102 applies the above-described urging force F to the urged surface 423*q*. An inclined surface 4104 for guiding a lower end portion of the urged surface 423*q* and smoothly opposing the pressing member 4102 to the urged surface 423*q* when setting the developing cartridge C from above to the tray 418 can be provided to the pressing member 4102. Further, the configuration of the urging portion 4100 is not limited to the illustrated configuration, and for example, an urging member such as a spring attached to the tray 418 can directly press the urged surface 423*q*.

As illustrated in FIG. 36A, in a state where the door 413 is closed, the tray 418 is abutted against a regulating portion 413*a* of the door 413. Thereby, movement to the draw-out direction D2 is regulated. Further, by the own weight of the developing cartridge C described earlier, the force Fh of the component in the parallel direction is set greater than the force in which the coupling pin 69 is withdrawn from the first support hole 423*a*. Thereby, the rear end in the insertion direction of the first support hole 423*a* (and the second support hole 423*b*) can be abutted against the coupling pin 69 reliably. Then, the abutment position of the developing roller 432 to the photosensitive drum 62 can be stabilized.

According to the present embodiment, similar to the first embodiment, a configuration has been illustrated where the photoconductor cartridge B is guided by the guide members 19*a* and 19*b* of the apparatus body A. However, similar to the second embodiment, a configuration can be adopted where the photoconductor cartridge B is first set from above to the upper tray 101 of the apparatus body A, and thereafter attached together with the upper tray 101. According further to the present embodiment, the urging portion 4100 is provided on the tray 418. Instead, the urging portion can be provided on the door 413 of the apparatus body A, and in a state where the door is 413 closed, the coupling pin 69 can be abutted against the rear end in the inserting direction of the first support hole 423*a* (and the second support hole 423*b*) of the developing cartridge C.

Further according to the present embodiment, the regulating portion 413*a* of the door 413 is used for regulating movement of the tray 418 in the draw-out direction D2, but the present invention is not restricted thereto. The movement to the draw-out direction D2 should be regulated until the tray 418 closes the door 413 of the apparatus body A and the image forming apparatus IF is capable of forming images. As another regulating portion, a mechanism for regulating the tray 418 at the attachment completed position can be provide on the tray 418 or the apparatus body A or on both the tray 418 and the apparatus body A (not shown).

Fourth Embodiment

Figure 37A:
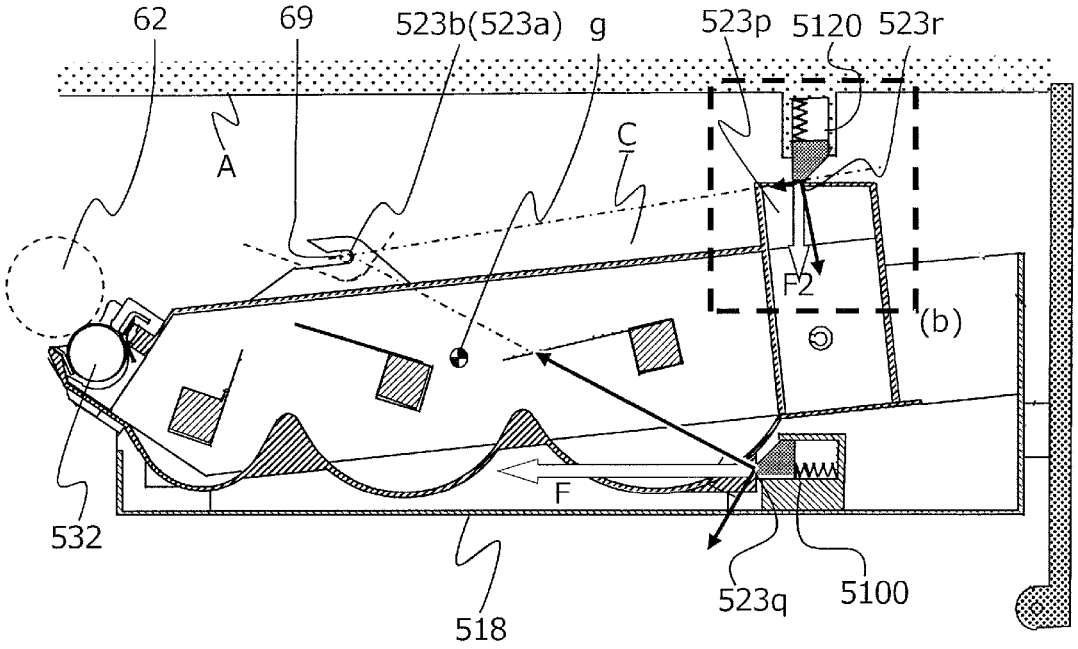
FIG. 37A is a cross-sectional view illustrating a configuration of a developing cartridge and an apparatus body according to a fourth embodiment.
Figure 37B:
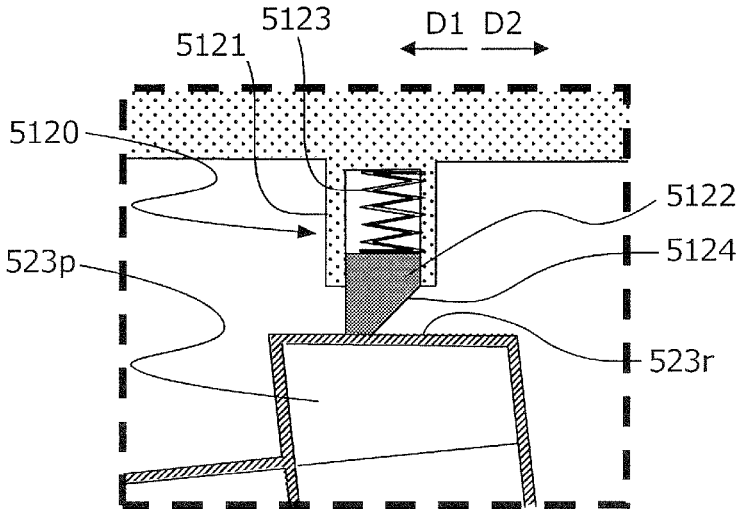
FIG. 37B is an enlarged cross-sectional view illustrating a second urged surface and a second urging unit according to the fourth embodiment.
Figure 38:
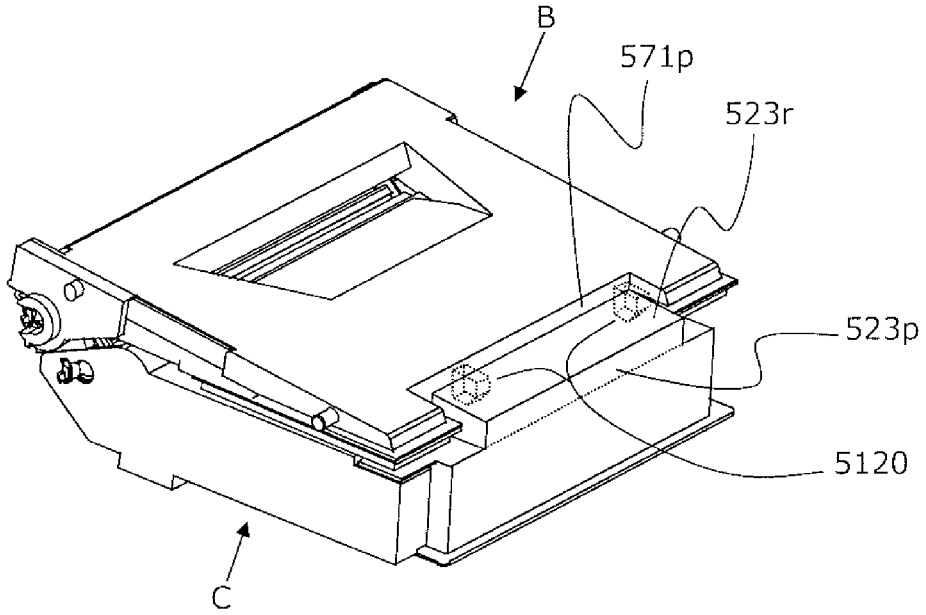
FIG. 38 is a perspective view of a photoconductor cartridge and the developing cartridge arranged in the apparatus body according to the fourth embodiment.

A fourth embodiment will be described with reference to FIGS. 37A and 37B. FIG. 37A is a cross-sectional view illustrating a configuration of a developing cartridge C and an apparatus body A according to the present embodiment. FIG. 37B is an enlarged cross-sectional view in which a second urged surface 523*r* and a second urged portion 5120 of FIG. 37A are illustrated in enlarged view. FIG. 38 is a perspective view of the photoconductor cartridge B and the developing cartridge C in the apparatus body A according to the present embodiment. The configurations and components that are identical to, correspond to or have the same effect as those of the first embodiment are denoted with the same reference numbers, and detailed descriptions thereof are omitted.

In the third embodiment, the urging portion 4100 according to the tray 418 is arranged in a direction urging the first support hole 423*a* (and the second support hole 423*b*) of the developing cartridge C in the groove direction. The urging direction of the urging portion 4100 is approximately the same as the opening direction of the groove shape of the first support hole 423*a* (and the second support hole 423*b*) serving as the engaged portion. Thereby, the first support hole 423*a* (and the second support hole 423*b*) can be prevented from being withdrawn from the coupling pin 69. Among the urging force F of the urging portion 4100, the component of force for swinging and rotating the developing cartridge C to abut the developing roller 432 against the photosensitive drum 62 is only the component of force in a direction perpendicular to a straight line connecting the urged surface 423*q* and the coupling pin 69. As a result, ratio of force used for swinging the developing cartridge C around the coupling pin 69 serving as fulcrum is not high. Thus, the urging force of the urging portion 4100 must be set high, and as a result, if a large amount of force for abutting the developing roller 432 to the photosensitive drum 62 is to be ensured, attachment property of the developing cartridge C to the tray 418 may be deteriorated.

Therefore, according to the present embodiment, an urging portion 5100 for urging the developing cartridge C in the insertion direction D1 is provided to the tray 518, and a second urged portion 5120 that urges the developing cartridge C from a direction that differs from the urging portion 5100 is provided to the apparatus body A, as illustrated in FIG. 37A. On the developing cartridge C, an urged surface 523*q* is provided to correspond to the urging portion 5100 and a second urged surface 523*r* is provided to correspond to the second urged portion 5120. As described, the urged surface of the developing cartridge C is formed of a surface intersecting the insertion direction D of the developing cartridge and/or an upper surface of the developing cartridge C. The configuration of the urging portion 5100 is basically the same as the urging portion 4100 of the third embodiment, so that the description thereof will be omitted.

The other urging portion 5120 is composed of a supporting portion 5121 fixed to the apparatus body A, a pressing member 5122 supported on the supporting portion 5121, and a spring 5123 serving as an urging member for urging the pressing member 5122, as illustrated in FIG. 37B. The pressing member 5122 is slidable in a direction intersecting the insertion direction D1 with respect to the supporting portion 5121, that is, especially the direction perpendicular to the insertion direction D1, and it is arranged to abut against the second urged surface 523*r* in a state where the developing cartridge C is inserted to the apparatus body A. When urged by the spring 5123, the pressing member 5122 is configured to apply the above-described urging force F2 to the second urged surface 523*r*. The pressing member 5122 can be provided with an inclined surface 5124 that guides a downstream end in the insertion direction of the second urged surface 523*r* to smoothly arrange the pressing member 5122 to oppose to the second urged surface 523*r* when the developing cartridge C is inserted to the apparatus body A. The configuration of the urging portion 5120 is not limited to the illustrated configuration, and for example, a configuration can be adopted where an urging member such as a spring attached to the apparatus body A directly presses the second urged surface 523*r*.

The second urged surface 523*r* and the second urged portion 5120 will be described in further detail with reference to FIGS. 37B and 38. Similar to the first embodiment, at an upstream end in the insertion direction D1 of the developing cartridge C, a part 523*p* which is overlapped with the photoconductor cartridge B and which is a protruded portion that protrudes from the photoconductor cartridge B in the direction perpendicular to the attachment direction, that is, the insertion direction D1, is provided. The protruded portion (523*p*) is shorter than the photosensitive drum 62 in the axial direction of the photosensitive drum 62 (FIG. 38). Further, a cutout shape 571*p*, i.e., recessed portion, is provided to a portion of the photoconductor cartridge B that corresponds to the overlapping part 523*p*. The second urged surface 523*r* is provided to an upper surface of the part 523*p* that is overlapped with the photoconductor cartridge B. This position is an upstream end in the insertion direction D1, as described earlier, and it is farther than the coupling pin 69 when compared with other parts. As a result, a developing roller 532 can be abutted against the photosensitive drum 62 by a small second urging force F2 of the second urged portion 5120.

Thereby, the urging portion 5100 enables to prevent a first support hole 523*a* (and a second support hole 523*b*) from being withdrawn from the coupling pin 69. Further, the second urged portion 5120 can be used to set the first support hole 523*a* (and the second support hole 523*b*) at the center of swinging rotation of the developing cartridge C, and the developing roller 532 can be pressed against the photosensitive drum 62. Thus, the configuration enables to prevent unnecessarily high urging force from being applied to the urging portion 5100 and the second urged portion 5120.

Further, urging force to the second urged portion 5120 should preferably be applied after the urging force of the urging portion 5100 has been applied to the developing cartridge C. Thereby, the first support hole 523*a* (and the second support hole 523*b*) can be abutted against the coupling pin 69 more reliably.

As described above, the present technique enables to further develop the conventional configuration. Further, for example, the present technique provides an image forming unit and an image forming apparatus that enable easy replacement of cartridges in a configuration where a plurality of cartridges are attached.

Other Embodiments

Embodiments described according to the aforementioned embodiments were mere examples for carrying out the present invention, and other modifications are possible within the scope of the technical ideas of the present technique. For example, the image forming unit may include a cartridge other than the photoconductor cartridge B and the developing cartridge C, such as a toner cartridge capable of being detachably attached to the developing cartridge C.

Further, the coupling pin 69 and the first and second support holes 23*a* and 23*b* are mere examples of the engagement portion and the engaged portions. Instead of the configuration of the above-illustrated embodiments, for example, a shaft member can be provided in the developing cartridge C, and a groove-shaped portion that is engaged with the shaft member can be provided in the photoconductor cartridge B. According to the first and second embodiments, the coupling pins 69 and 69 are arranged on both end portions in the reference axis direction X of the photoconductor cartridge B, and the first and second support holes 23*a* and 23*b* are arranged on both end portions in the reference axis direction X of the developing cartridge C, but the arrangement of the present invention is not limited thereto. The configuration can include one set of engagement portion and engaged portion, or more than three sets. However, the position or positions at which the engagement portion(s) and the engaged portion(s) engage should preferably be arranged symmetrically with respect to the reference axis direction X.

According to the present embodiment, driving force can be transmitted from the second cartridge to the first cartridge in the image forming unit in which the second cartridge is arranged detachably from the first cartridge.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2019-032129, filed on Feb. 25, 2019, and 2019-213564, filed on Nov. 26, 2019, which are hereby incorporated by reference herein in their entirety.

What is claimed is:

1. An image forming apparatus comprising:

an apparatus body including a shaft member;

a first cartridge comprising an image bearing member configured to rotate, a connecting portion configured to transmit a rotational force from the shaft member to the image bearing member, and an engagement portion, the first cartridge being detachably attached to the apparatus body so as to be located in an attachment position, the connecting portion configured to be capable of receiving the rotational force from the shaft member in a state where the first cartridge is located in the attachment position;

a second cartridge comprising a developer bearing member configured to bear developer used to develop a latent image borne on the image bearing member, and an engaged portion configured to be engaged with the engagement portion;

a guide unit configured to guide the first cartridge in a direction intersecting an axial direction of the image bearing member; and a drawer member to which the second cartridge is detachably attached, the drawer member being configured to be inserted to and drawn out of the apparatus body in a direction intersecting the axial direction, wherein in a case where the second cartridge is attached to the apparatus body, the drawer member is inserted to the apparatus body in a state supporting the second cartridge, wherein in a state where the first cartridge is located in the attachment position, the second cartridge is configured to be moved by the drawer member between a first position where the engaged portion is engaged with the engagement portion and a second position where the second cartridge can be detached from the drawer member, and wherein the engaged portion is configured to be engaged with the engagement portion in a course of inserting the drawer member to the apparatus body, and the second cartridge is supported by the first cartridge via engagement of the engagement portion and the engaged portion.

2. The image forming apparatus according to claim 1, wherein the guide unit comprises a guide member that is provided on the apparatus body and that is configured to guide the first cartridge in a direction intersecting the axial direction.

3. The image forming apparatus according to claim 1, wherein the guide unit comprises another drawer member that is configured to be inserted to and drawn out of the apparatus body in a direction intersecting the axial direction, the other drawer member being inserted to the apparatus body in a state supporting the first cartridge.

4. The image forming apparatus according to claim 1, wherein the first cartridge comprises a cleaning member configured to clean a surface of the image bearing member, and a first opening portion configured to discharge waste removed from the image bearing member by the cleaning member to an exterior of the first cartridge, and wherein the second cartridge comprises a second opening portion configured to receive the waste discharged from the first opening portion, and a storage portion configured to store the waste flowing in through the second opening portion.

5. The image forming apparatus according to claim 1, wherein the connecting portion of the first cartridge is a first connecting portion and the shaft member of the apparatus body is a first shaft member, wherein the second cartridge comprises a second connecting portion configured to be connected to a second shaft member provided on the apparatus body and configured to transmit rotation of the second shaft member to the developer bearing member, and wherein at least one of the first connecting portion and the second connecting portion comprises a coupling member capable of tilting with respect to the axial direction.

6. The image forming apparatus according to claim 1, wherein the second cartridge comprises a portion that is overlapped with the first cartridge when viewed in a direction in which the first cartridge is attached to and detached from the apparatus body, the portion being configured to restrict the first cartridge from being attached to and detached from the apparatus body in a state where the second cartridge has been attached to the apparatus body.

7. The image forming apparatus according to claim 1, wherein at least one of the engagement portion and the engaged portion is a groove shape that is extended in an insertion direction of the drawer member to the apparatus body when viewed in the axial direction, and wherein the other one of the engagement portion and the engaged portion is a shaft member that extends in the axial direction.

8. The image forming apparatus according to claim 7, wherein the groove shape includes an inclined surface that is inclined with respect to the insertion direction, the inclined surface being configured to abut against the shaft member to lift the second cartridge upward from the drawer member in a case where the drawer member is inserted to the apparatus body.

9. The image forming apparatus according to claim 1, wherein the second cartridge is configured to swing in a direction in which the developer bearing member approaches and is separated from the image bearing member around a portion where the engagement portion and the engaged portion are engaged when viewed in the axial direction, and wherein the image forming apparatus further comprises an urging portion configured to urge the second cartridge in a direction in which the developer bearing member approaches the image bearing member so as to position the developer bearing member with respect to the image bearing member.

10. The image forming apparatus according to claim 9, wherein an urged surface that is urged by the urging portion is provided on the second cartridge.

11. The image forming apparatus according to claim 10, wherein the urged surface is either a surface intersecting an insertion direction of the drawer member with respect to the apparatus body, or an upper surface of the second cartridge.

12. The image forming apparatus according to claim 1, wherein the engagement portion is provided at both end portions in the axial direction of the first cartridge, and wherein the engaged portion is provided at both end portions in the axial direction of the second cartridge.

13. The image forming apparatus according to claim 1, wherein the first cartridge is positioned by the apparatus body with respect to the axial direction in a state where the first cartridge is located in the attachment position.

14. An image forming unit configured to be attached to an apparatus body of an image forming apparatus, the apparatus body comprising a shaft member and a guide unit, the image forming unit comprising:

a first cartridge comprising an image bearing member configured to rotate, a connecting portion configured to transmit a rotational force from the shaft member to the image bearing member, and an engagement portion, the first cartridge being configured to be detachably attached to the apparatus body so as to be located in an attachment position, the connecting portion configured to be capable of receiving the rotational force from the shaft member when the first cartridge is located in the attachment position; and a second cartridge comprising a developer bearing member configured to bear developer used for developing a latent image borne on the image bearing member and an engaged portion configured to be engaged with the engagement portion, wherein the first cartridge is configured to be guided in a direction intersecting an axial direction of the image bearing member by the guide unit, wherein the second cartridge is configured to be detachably attached to a drawer member that is configured to be inserted to and drawn out of the apparatus body, and the second cartridge is configured to be inserted to the apparatus body in a state where the second cartridge is supported by the drawer member, wherein, in a state where the first cartridge is located in the attachment position, the second cartridge is configured to be moved by the drawer member between a first position where the engaged portion is engaged with the engagement portion and a second position where the second cartridge can be detached from the drawer member, wherein the engaged portion is configured to be engaged with the engagement portion in a course of inserting the drawer member to the apparatus body, and the second cartridge is supported by the first cartridge via engagement of the engagement portion and the engaged portion in a state where the second cartridge has been attached to the apparatus body.

15. The image forming unit according to claim 14, wherein the first cartridge is positioned by the apparatus body with respect to the axial direction in a state where the first cartridge is located in the attachment position.

* * * * *